US008947486B2

(12) United States Patent
Tsuchiya

(10) Patent No.: US 8,947,486 B2
(45) Date of Patent: Feb. 3, 2015

(54) LIGHT EMITTING ELEMENT HEAD, LIGHT EMITTING ELEMENT ARRAY CHIP, AND IMAGE FORMING APPARATUS

(75) Inventor: Ken Tsuchiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/301,187

(22) Filed: Nov. 21, 2011

(65) Prior Publication Data

US 2012/0194629 A1 Aug. 2, 2012

(30) Foreign Application Priority Data

Jan. 27, 2011 (JP) ..... 2011-015409
Sep. 1, 2011 (JP) ..... 2011-191019

(51) Int. Cl.

| | |
|---|---|
| ***B41J 2/45*** | (2006.01) |
| ***B41J 2/435*** | (2006.01) |
| ***B41J 2/47*** | (2006.01) |
| ***B41J 27/00*** | (2006.01) |

(52) U.S. Cl.

CPC ..... *B41J 2/45* (2013.01)
USPC ..... 347/238; 347/224; 347/248; 347/225; 347/254; 347/256; 347/257

(58) Field of Classification Search

USPC ..... 347/238, 254, 224, 248, 225, 256–257
See application file for complete search history.

(56) References Cited

U.S. PATENT DOCUMENTS

| | | | | |
|---|---|---|---|---|
| 5,943,463 | A * | 8/1999 | Unuma et al. | 385/119 |
| 6,593,559 | B2 * | 7/2003 | Yamakawa | 250/208.1 |
| 2004/0008247 | A1 | 1/2004 | Masuda | |
| 2007/0070166 | A1 * | 3/2007 | Mikami et al. | 347/130 |
| 2009/0185828 | A1 * | 7/2009 | Koizumi et al. | 399/218 |
| 2009/0225148 | A1 | 9/2009 | Itami et al. | |
| 2010/0060704 | A1 | 3/2010 | Tsuchiya | |
| 2010/0177155 | A1 * | 7/2010 | Kii | 347/224 |

FOREIGN PATENT DOCUMENTS

| | | | |
|---|---|---|---|
| JP | 2004066649 | A * | 3/2004 |
| JP | A-2004-66649 | | 3/2004 |
| JP | 2006272685 | A * | 10/2006 |
| JP | A-2006-272685 | | 10/2006 |
| JP | A-2009-214396 | | 9/2009 |
| JP | A-2010-064338 | | 3/2010 |

OTHER PUBLICATIONS

Extended European Search Report issued in European Patent Application No. 11193323.0 dated May 21, 2012.

* cited by examiner

*Primary Examiner* — Sarah Al Hashimi
(74) *Attorney, Agent, or Firm* — Oliff PLC

(57) ABSTRACT

A light emitting element head includes a first light emitting element array, a second light emitting element array, and an optical device. The first light emitting element array includes a plurality of light emitting elements arranged in a main scan direction. The second light emitting element array includes a plurality of light emitting elements arranged in the main scan direction. The optical device focuses a light output from the first light emitting element array and the second light emitting element array on a photoreceptor to form an electrostatic latent image on the photoreceptor. The first light emitting element array and the second light emitting element array are overlapped each other in a sub scan direction in an overlapping section. Interval between the light emitting elements of the first light emitting element array are different from interval between the light emitting elements of the second light emitting element array.

6 Claims, 18 Drawing Sheets

LIGHT EMITTING ELEMENT HEAD, LIGHT EMITTING ELEMENT ARRAY CHIP, AND IMAGE FORMING APPARATUS

CROSS-REFERENCE TO RELATED APPLICATIONS

This application is based upon and claims priority under 35 USC 119 from Japanese Patent Application Nos. 2011-015409, filed Jan. 27, 2011, and 2011-191019, filed Sep. 1, 2011.

BACKGROUND

Technical Field

The invention relates to a light emitting element head, a light emitting element array chip, and an image forming apparatus.

SUMMARY OF THE INVENTION

According to an aspect of the invention, a light emitting element head includes a first light emitting element array, a second light emitting element array, and an optical device. The first light emitting element array includes a plurality of light emitting elements arranged in a main scan direction. The second light emitting element array includes a plurality of light emitting elements arranged in the main scan direction. The optical device focuses a light output from the first light emitting element array and the second light emitting element array on a photoreceptor to form an electrostatic latent image on the photoreceptor. The first light emitting element array and the second light emitting element array are overlapped each other in a sub scan direction in an overlapping section. An interval between the light emitting elements of the first light emitting element array in the overlapping section are different from an interval between the light emitting elements of the second light emitting element array in the overlapping section.

BRIEF DESCRIPTION OF THE DRAWINGS

Exemplary embodiments of the invention will be described in detail based on the following figures, wherein.

DETAILED DESCRIPTION

Hereinafter, embodiments of the invention will be described in detail with reference to the accompanying drawings.

<Description of Image Forming Apparatus>

Figure 1:
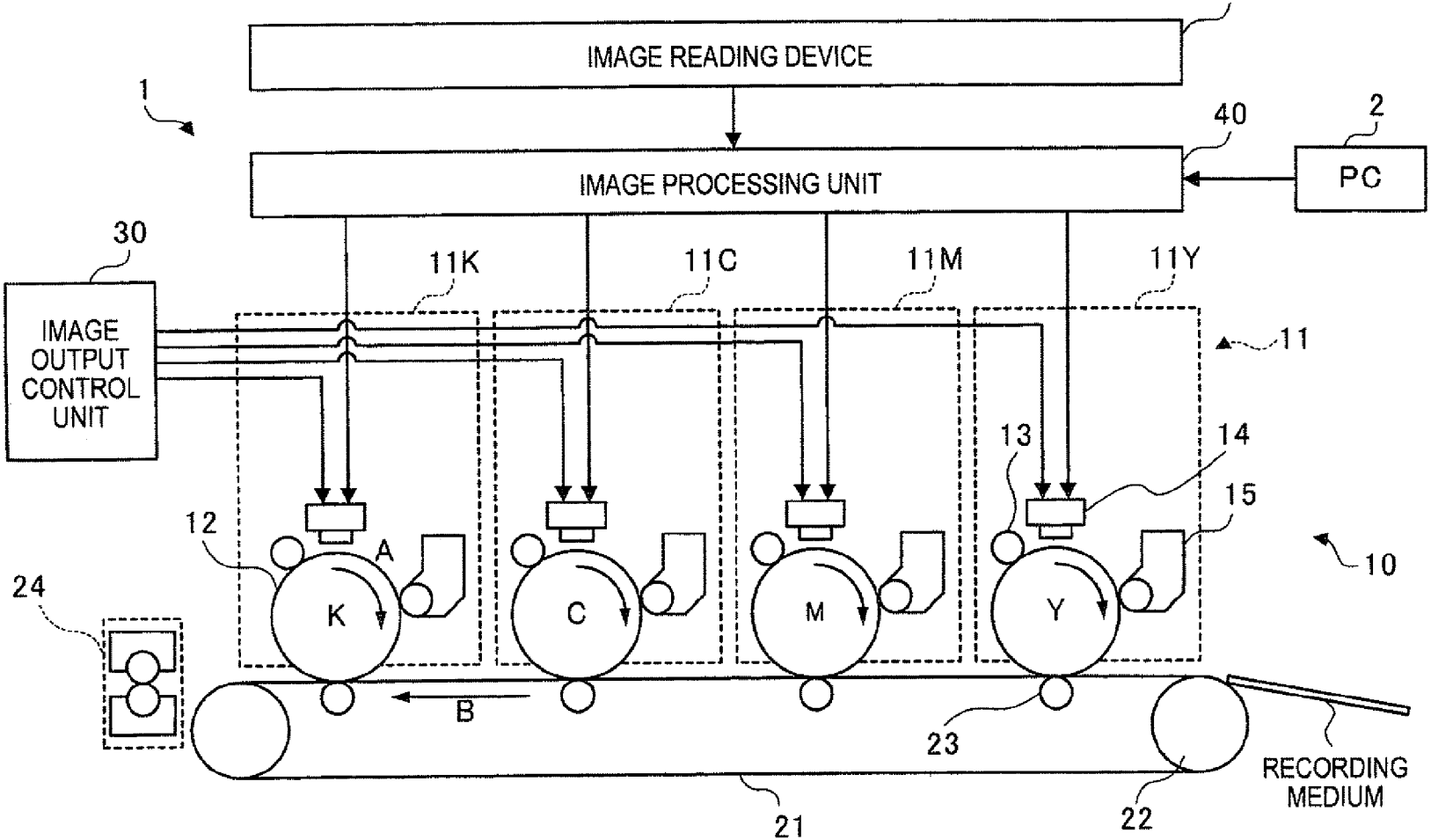
FIG. 1 is a view illustrating an example of an entire configuration of an image forming apparatus according to an exemplary embodiment.

FIG. 1 is a view illustrating an example of an entire configuration of an image forming apparatus according to an exemplary embodiment.

An image forming apparatus 1 shown in FIG. 1 is an image forming apparatus generally called a tandem type. The image forming apparatus 1 includes an image forming process unit 10 for forming an image corresponding to image data of each color, an image output control unit 30 for controlling the image forming process unit 10, and an image processing unit 40 that is connected to, for example, a personal computer (PC) 2 and an image reading device 3 and performs a predetermined image process on image data received from the personal computer (PC) 2 and the image reading device 3.

The image forming process unit 10 includes an image forming unit 11 having a plurality of engines disposed in parallel at constant intervals. The image forming unit 11 includes four image forming units 11Y, 11M, 11C, and 11K which are examples of toner-image forming means. Each of the image forming units 11Y, 11M, 11C, and 11K includes a photoreceptor drum 12 which is an example of an image carrier for forming an electrostatic image and holding a toner image, a charging device 13 for charging a photoreceptor applied on the surface of the photoreceptor drum 12 at a predetermined potential, a light emitting element head 14 for forming the electrostatic latent image by exposing the photoreceptor charged by the charging device 13, and a developing device 15 which is an example of a developing means for developing the electrostatic latent image formed by the light emitting element head 14. Here, the image forming units 11Y, 11M, 11C, and 11K have almost the same configuration except for toner contained in the developing devices. The image forming units 11Y, 11M, 11C, and 11K form yellow (Y), magenta (M), cyan (C) and black (K) color toner images, respectively.

Also, the image forming process unit 10 includes a paper sheet transfer belt 21 for transferring a recording paper sheet in order to superimposingly transfer the color toner images formed on the photoreceptor drums 12 of the image forming units 11Y, 11M, 11C, and 11K onto the recording paper sheet, a driving roller 22 which is a roller for driving the paper sheet transfer belt 21, transfer rollers 23 which are examples of transfer means for transferring the toner images of the photoreceptor drums 12 onto the recording paper sheet, and a fixing device 24 which is an example of a fixing means for fixing the toner images to the recording paper sheet.

In the image forming apparatus 1, the image forming process unit 10 performs an image forming operation based on various control signals supplied from the image output control unit 30. Under the control of the image output control unit 30, the image data received from the personal computer (PC) 2 and the image reading device 3 is subjected to an image process by the image processing unit 40 and is supplied to the image forming unit 11. Then, for example, in the image forming unit 11K for the black (K) color, the photoreceptor drum 12 is charged at the predetermined potential by the charging device and is exposed by the light emitting element head 14 emitting light based on the image data supplied from the image processing unit 40 while rotating in a direction of an arrow A. Thereby, an electrostatic latent image for a black (K) color image is formed on the photoreceptor drum 12. Next, the electrostatic latent image formed on the photoreceptor drum 12 is developed by the developing device 15 such that a black (K) color toner image is formed on the photoreceptor drum 12. In the same manner, yellow (Y), magenta (M), and cyan (C) color toner images are formed in the image forming units 11Y, 11M, and 11C, respectively.

The color toner images on the photoreceptor drums 12 formed in the image forming unit 11 are electrostatically transferred in sequence onto the fed recording paper sheet by an electric field for transfer applied to the transfer rollers 23 while the paper sheet transfer belt 21 moves in a direction of an arrow B, such that toners of the individual colors are superimposed on the recording paper sheet, so as to form a composite toner image.

Next, the recording paper sheet having the composite toner image electrostatically transferred thereon is transferred to the fixing device 24. The composite toner image on the recording paper sheet reaching the fixing device 24 is subjected to a fixing process using heat and pressure by the fixing device 24, so as to be fixed to the recording paper sheet, and the recording paper sheet is discharged from the image forming apparatus 1.

<Description of Light Emitting Element Head>

Figure 2:
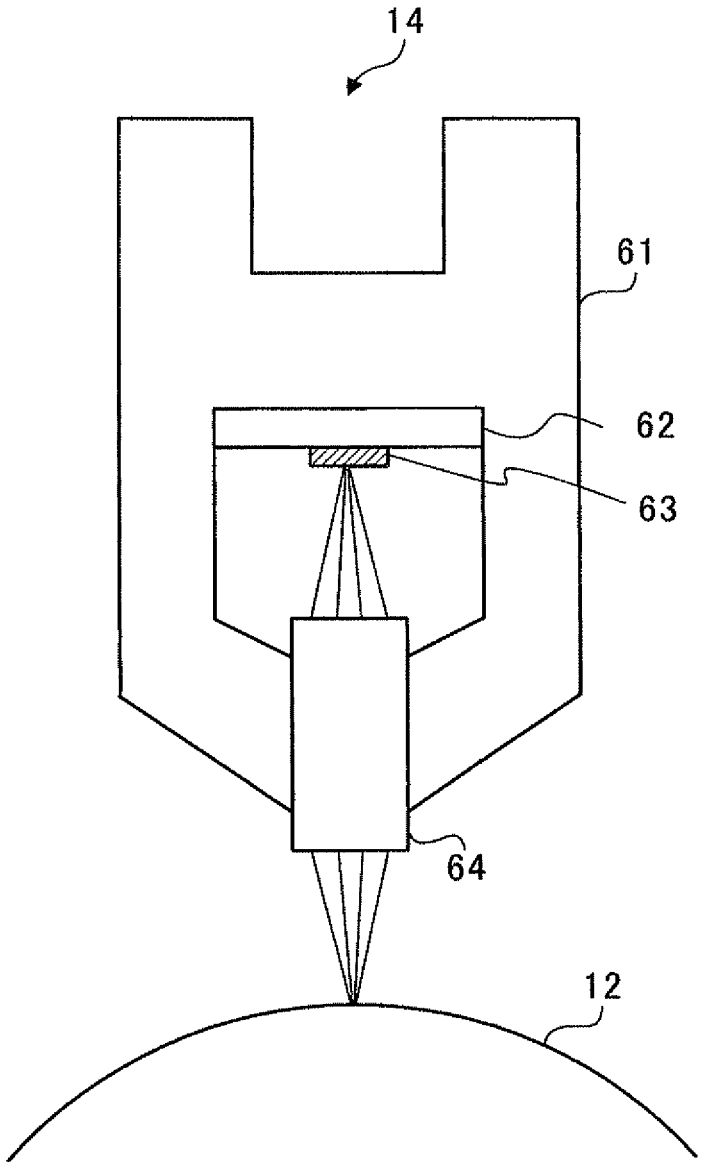
FIG. 2 is a view illustrating a configuration of a light emitting element head according to the exemplary embodiment.

FIG. 2 is a view illustrating a configuration of the light emitting element head 14 according to the exemplary embodiment. The light emitting element head 14 includes a housing 61, a light emitting unit 63 having a plurality of LEDs as light emitting elements, a circuit board 62 mounted on the light emitting unit 63 or a signal generating circuit 100 (see FIG. 3 to be described below), and a rod lens (radial gradient index lens) array 64 that is an example of an optical device for focusing a light output emitted from the LEDs to expose the photoreceptor drum 12, thereby forming an electrostatic latent image.

The housing 61 is made of, for example, a metal, and supports the circuit board 62 and the rod lens array 64, and a light emitting point of the light emitting unit 63 and a focal plane of the rod lens array 64 are set to correspond to each other. Further, the rod lens array 64 is disposed along an axial direction (main scan direction) of the photoreceptor drum 12.

<Description of Light Emitting Unit>

Figure 3:
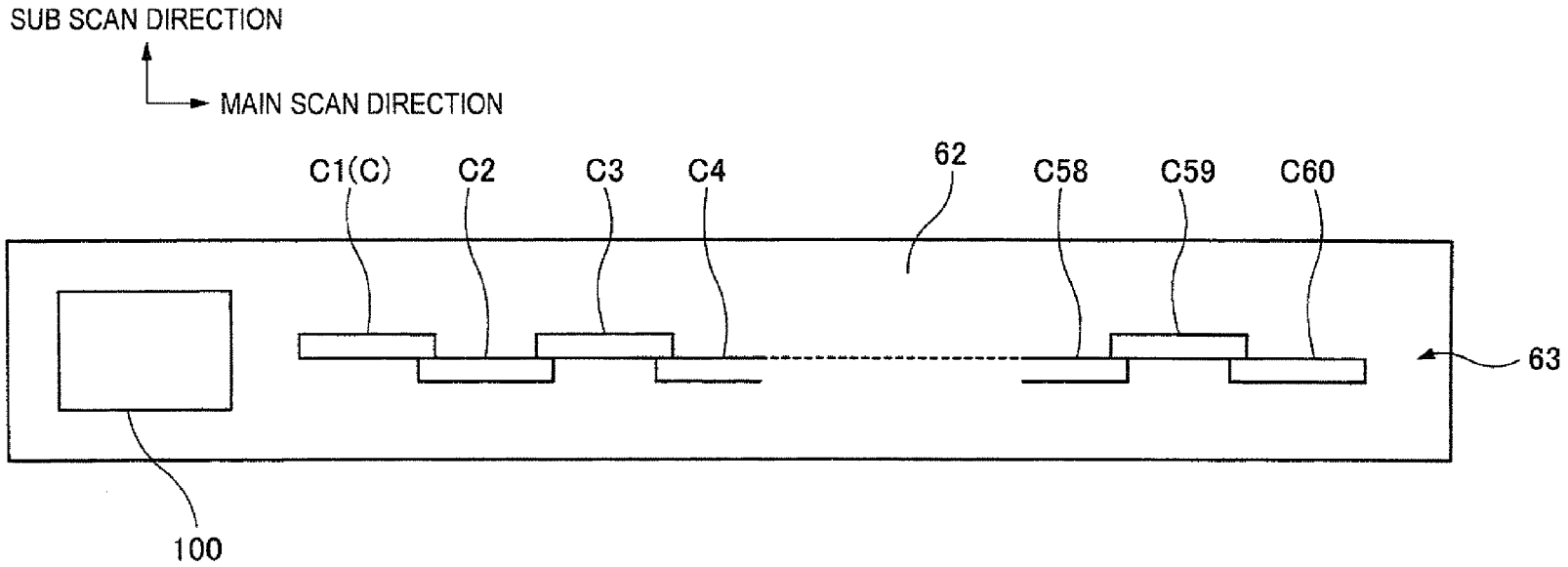
FIG. 3 is a top view of a circuit board and a light emitting unit in the light emitting element head.

FIG. 3 is a top view of the circuit board 62 and the light emitting unit 63 in the light emitting element head 14.

As shown in FIG. 3, the light emitting unit 63 is configured by disposing 60 light emitting chips C (C1 to C60), which are examples of light emitting element array chips, in zigzag, in two rows facing each other in the main scan direction on the circuit board 62. The circuit board 62 has the signal generating circuit 100 mounted thereon as an example of a control unit for controlling light emission of the light emitting element arrays (see FIG. 4 to be described below) of the light emitting chips C.

<Description of Light Emitting Element Array Chip>

Figure 4A:
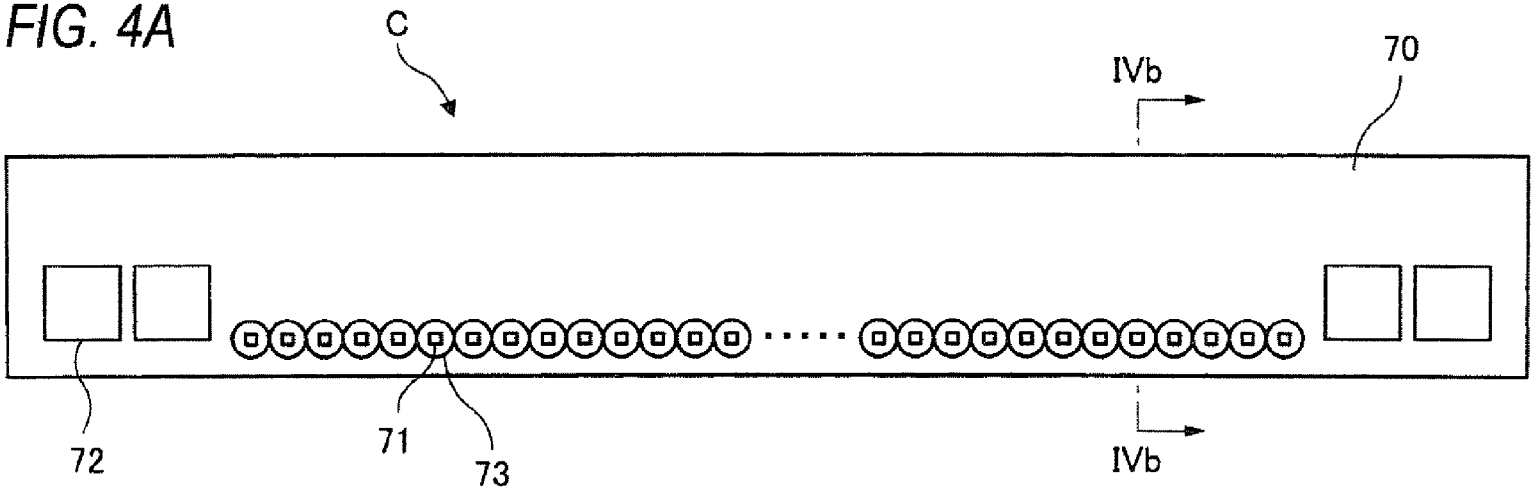
FIGS. 4A and 4B are views illustrating a configuration of a light emitting chip according to the exemplary embodiment.
Figure 4B:
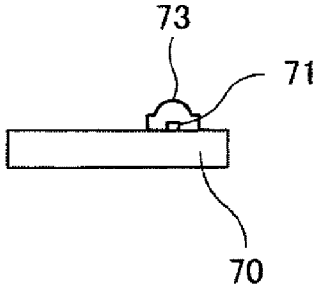

FIGS. 4A and 4B are views illustrating a configuration of a light emitting chip C according to the exemplary embodiment.

FIG. 4A is a view illustrating the light emitting chip C when seen from a direction in which the LEDs emit light. FIG. 4B is a cross-sectional view along a line IVb-IVb of FIG. 4A.

In the light emitting chip C, a plurality of LEDs 71 are disposed in a line in the main scan direction at equal intervals, as an example of a light emitting element array. On the both side of a base board 70, bonding pads 72 are disposed, as an example of an electrode unit for inputting and outputting a signal for driving the light emitting element array, with the light emitting element array interposed therebetween. On the light emission side of each of the LEDs 71, a micro lens 73 is formed. The micro lenses 73 make it possible to condense light emitted from the LEDs 71 such that the light is efficiently incident to the photoreceptor drums 12 (see FIG. 2).

It is preferable that the micro lenses 73 should be made of a transparent resin such as a light curing resin and have an aspherical surface for condensing the light more efficiently. The size, thickness, focal length, and the like of the micro lenses 73 are determined based on a wavelength of the used LEDs 71, a refractive index of the used light curing resin, etc.

<Description of Self-Scanning Light Emitting Element Array Chip>

In this embodiment, it is preferable to use self-scanning light emitting element (SLED) array chips as the light emitting element array chips exemplified as the light emitting chips C. The self-scanning light emitting element array chips are configured to be capable of implementing self-scanning of light emitting elements by using light emitting thyristors having a pnpn structure as components of the light emitting element array chips.

Figure 5:
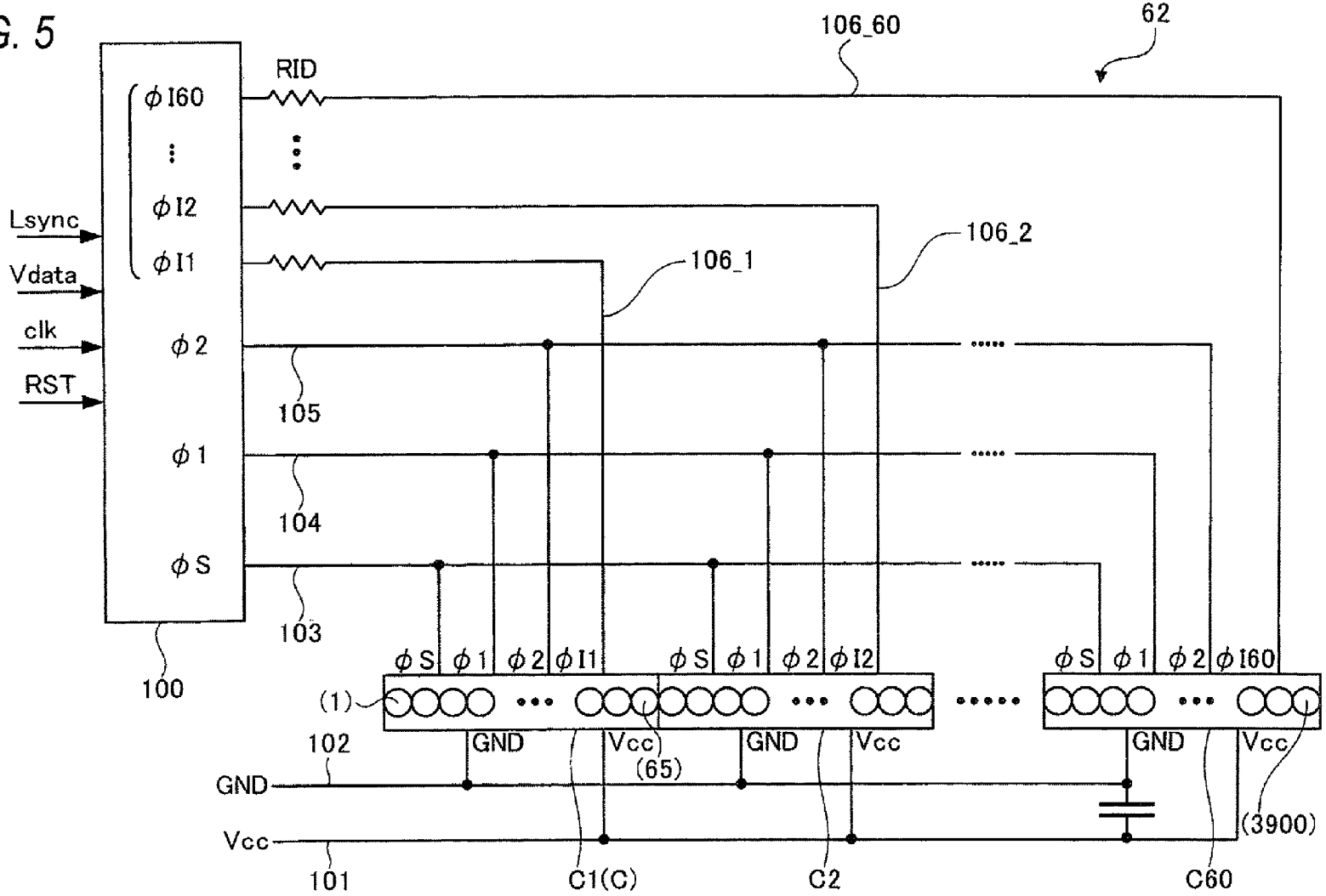
FIG. 5 is a view illustrating a configuration of a signal generating unit and a wiring configuration of the circuit board in a case where self-scanning light emitting element array chips are used as light emitting chips.

FIG. 5 is a view illustrating a configuration of the signal generating unit 100 and a wiring configuration of the circuit board 62 in a case where the self-scanning light emitting element array chips are employed as the light emitting chips C.

The signal generating circuit 100 is configured to receive various control signals such as a line synchronization signal Lsync, image data Vdata, a clock signal clk, a reset signal RST, and the like from the image output control unit 30 (see FIG. 1). The signal generating circuit 100 performs, for example, sorting of the image data Vdata, correction of an output value, and the like, based on the various control signals input externally, and outputs light emission signals $\phi$I ($\phi$I1 to $\phi$I60) to the light emitting chips C (C1 to C60), respectively. In this embodiment, each of the light emission signals $\phi$I ($\phi$I1 to $\phi$I60) is supplied to a corresponding one of the light emitting chips C (C1 to C60).

The signal generating circuit 100 outputs a start transmission signal $\phi$S, a first transmission signal $\phi$1, and a second transmission signal $\phi$2 to each of the light emitting chips C1 to C60, based on the various control signals input externally.

In the circuit board 62, there are provided a power supply line 101 for power supply that is connected to Vcc terminals of the light emitting chips C1 to C60 and supplies a power supply voltage Vcc of −5.0 V, and a power supply line 102 for ground that is connected to GND terminals of the light emitting chips C1 to C60. Further, in the circuit board 62, there are provided a start transmission signal line 103, a first transmission signal line 104, and a second transmission signal line 105 for transmitting the start transmission signal ϕS, the first transmission signal ϕ1, and the second transmission signal ϕ2 from the signal generating circuit 100. Furthermore, in the circuit board 62, there are provided 60 lines of light emission signal lines 106 (106_1 to 106_60) for outputting the light emission signals ϕI (ϕI1 to ϕI60) from the signal generating circuit 100 to the light emitting chips C (C1 to C60), respectively. Moreover, in the circuit board 62, there are provided 60 lines of light-emission-current limiting resistors RID for preventing an excessive current from flowing in the 60 light emission signal lines 106 (106_1 to 106_60). The light emission signals ϕI1 to ϕI60 each have two states composed of a high level state H and a low level state L as described below. A potential in the low level state is set to a potential of −5.0 V, and a potential in the high level state is set to a potential of ±0.0 V.

Figure 6:
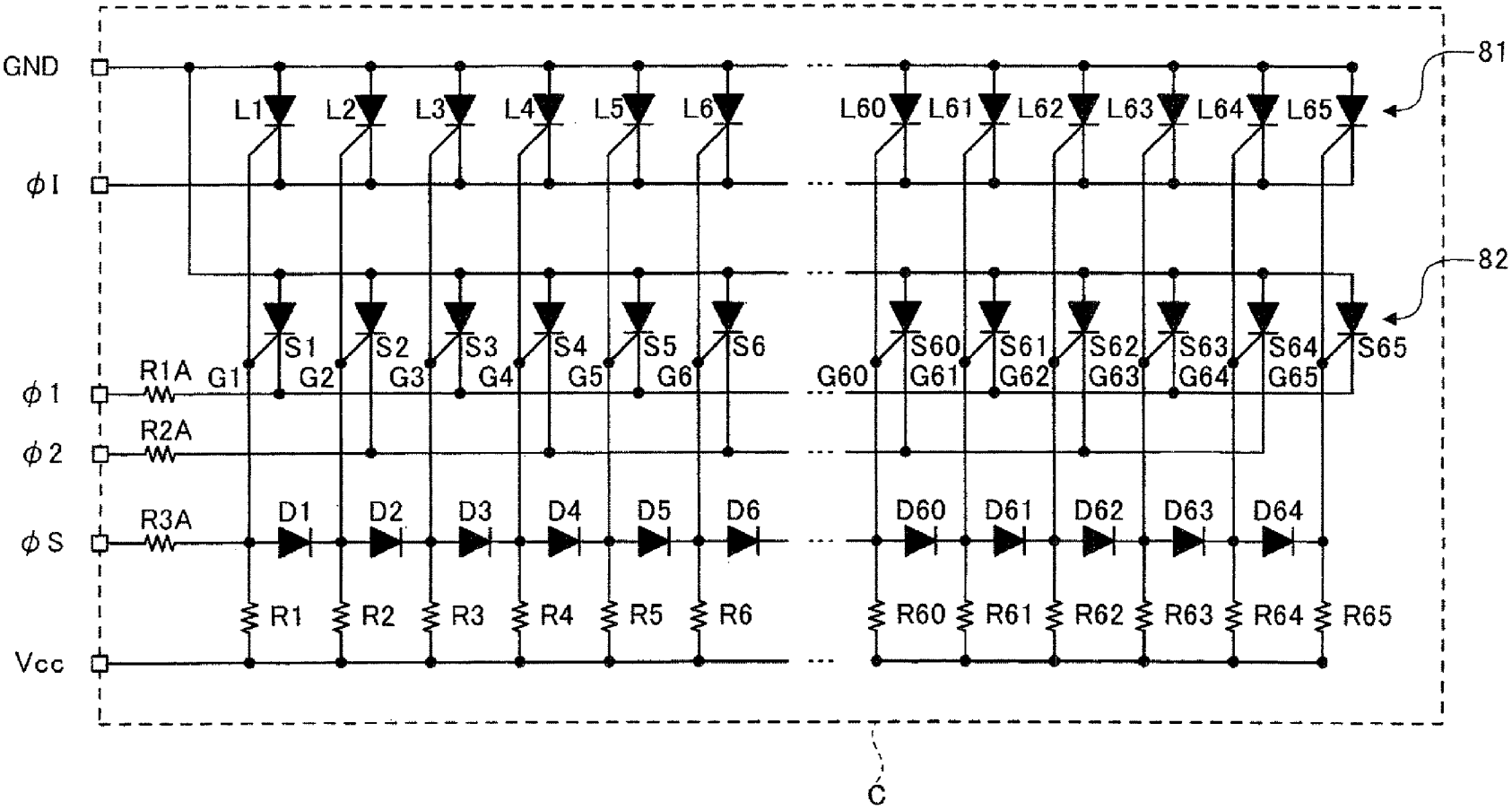
FIG. 6 is a view for explaining a circuit configuration of a light emitting chip.

FIG. 6 is a view for explaining a circuit configuration of a light emitting chip C (C1 to C60).

The light emitting chip C includes 65 transmission thyristors S1 to S65 and 65 light emitting thyristors L1 to L65. The light emitting thyristors L1 to L65 are configured to have the same pnpn connection as the transmission thyristors S1 to S65 and act as light emitting diodes (LEDs) by using pn connection of the pnpn connection. The light emitting chip C further includes 64 diodes D1 to D64 and 65 resistors R1 to R65. The light emitting chip C includes transmission-current limiting resistors R1A, R2A, and R3A for preventing an excessive current from flowing in signal lines for receiving the first transmission signal ϕ1, the second transmission signal ϕ2, and the start transmission signal ϕS. The light emitting thyristors L1 to L65 constituting a light emitting element array 81 are arranged in order of L1, L2, . . . , L64, and L65 from the left of FIG. 6, so as to form a light emitting element row, that is, the light emitting element array 81. Further, the transmission thyristors S1 to S65 are arranged in order of S1, S2, . . . , S64, and S65 from the left of FIG. 6, so as to form a switch device row, that is, a switch device array 82. Furthermore, the diodes D1 to D64 are arranged in order of D1, D2, . . . , D63, and D64 from the left of FIG. 6. Moreover, the resistors R1 to R65 are arranged in order of R1, R2, . . . , R64, and R65 from the left of FIG. 6.

Next, an electrical connection of each of the devices in the light emitting chip C will be described.

Anode terminals of the transmission thyristors S1 to S65 are connected to a GND terminal. The power supply line 102 (see FIG. 5) is connected to the GND terminal, so as to be grounded.

Cathode terminals of odd-numbered transmission thyristors S1, S3, . . . , and S65 are connected to a first transmission signal terminal through the transmission-current limiting resistor R1A. The first transmission signal terminal is connected to the first transmission signal line 104 (see FIG. 5), and receives the first transmission signal ϕ1.

Meanwhile, cathode terminals of even-numbered transmission thyristors S2, S4, . . . , and S64 are connected to a second transmission signal terminal through the transmission-current limiting resistor R2A. The second transmission signal terminal is connected to the second transmission signal line 105 (see FIG. 5), and receives the second transmission signal ϕ2.

Gate terminals G1 to G65 of the transmission thyristors S1 to S65 are connected to a Vcc terminal through the resistors R1 to R65 provided corresponding to the transmission thyristors S1 to S65, respectively. The Vcc terminal is connected to the power supply line 101 (see FIG. 5), and receives the power supply voltage Vcc (−5.0 V).

The gate terminals G1 to G65 of the transmission thyristors S1 to S65 are also connected one-to-one to the gate terminals of the corresponding light emitting thyristors L1 to L65 having the same numbers in its labels.

The gate terminals G1 to G64 of the transmission thyristors S1 to S64 are also connected to the anode terminals of the diodes D1 to D64, and the cathode terminals of the diodes D1 to D64 are connected to the gate terminals G2 to G65 of the transmission thyristors S2 to S65 at the next stages adjacent to the cathode terminals. In other words, the diodes D1 to D64 are connected in series with the gate terminals G2 to S64 of the transmission thyristors S2 to S64 interposed therebetween.

The anode terminal of the diode D1, that is, the gate terminal G1 of the transmission thyristor S1 is connected to a start transmission signal terminal through the transmission-current limiting resistor R3A. The start transmission signal terminal receives the start transmission signal ϕS through the start transmission signal line 103 (see FIG. 5).

Anode terminals of the light emitting thyristors L1 to L65 are connected to the GND terminal, similarly to the anode terminals of the transmission thyristors S1 to S65.

Cathode terminals of the light emitting thyristors L1 to L65 are connected to a light emission signal terminal. The light emission signal terminal is connected to a light emission signal line 106 (light emission signal line 106_1 in a case of the light emitting chip C1) (see FIG. 5) for receiving a light emission signal ϕI (light emission signal ϕI1 in the case of the light emitting chip C1). The other light emitting chips C2 to C60 receive corresponding light emission signals ϕI2 to ϕI60, respectively.

<Description of Magnification Correction>

Next, positional misalignment in the main scan direction in the light emitting element head 14 will be described.

There is a limit in the accuracy of the attachment of the light emitting chips C to the light emitting element head 14 and the accuracy of the formation of the light emitting thyristors in each light emitting chip C. In the above-mentioned rod lens array 64 (see FIG. 2), a variation in the focus position exists. Temperature irregularity may occur in the circuit board 62 (see FIG. 2) where the light emitting chips C are disposed, so as to cause irregularity of the thermal expansion in each light emitting chip C. This may change an exposure range in the main scan direction of the surface of the photoreceptor drum 12 from a predetermined range. In other words, a magnification in the main scan direction may change. For this reason, it is required to correct a change in the magnification in the main scan direction. Hereinafter, the correction on the change in the magnification in the main scan direction is referred to as magnification correction.

Figure 7A:
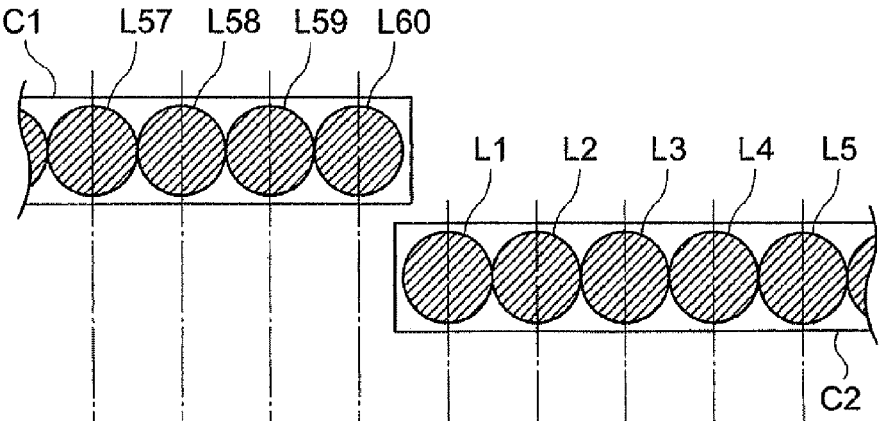
FIG. 7A to 7C are views illustrating a first example of magnification correction according to the related art.
Figure 7B:
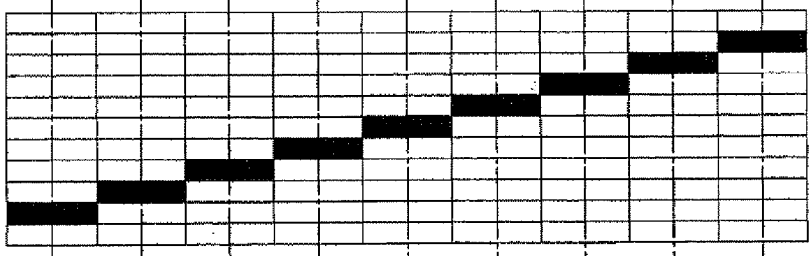
Figure 7C:
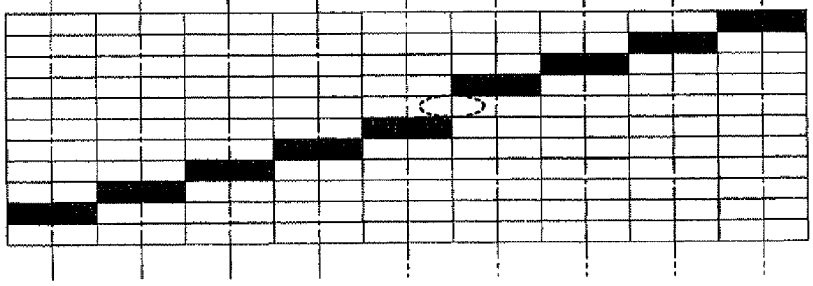

Magnification Correction means not only increasing of the exposure range in the main scan direction but also decreasing of the exposure range in the main scan direction FIGS. 7A to 7C are views illustrating a first example of magnification correction according to the related art.

In FIGS. 7A to 7C, a case where a diagonal image is formed is taken as an example. Here, a method of performing magnification correction by scaling the image down in the main scan direction when the magnification in the main scan direction has increased will be described. In FIG. 7B, an image before the magnification correction is conceptually shown, and in FIG. 7C, an image after the magnification correction is conceptually shown. In FIG. 7A, the light emitting thyristors L forming the images of FIGS. 7A and 7C are shown corresponding to the images.

The timings when the light emitting thyristors L are lighted may be controlled to draw diagonally consecutive dots by the light emitting thyristors L, thereby forming an image as shown in FIG. 7B. The image is perceived as a continuous diagonal line by human eyes. Meanwhile, FIG. 7C shows a case where one lighting datum has been removed in order to perform the magnification correction. In this case, it is possible to scale a formed image down in the main scan direction based on the removed datum. In other words, it is possible to perform magnification correction to scale the formed image down in the main scan direction. Meanwhile, in this case, the lack of one light datum results in a lack of a dot, corresponding to the removed datum, in the drawn image. Therefore, a vacant space occurs such that the dots are not consecutive in a sub scan direction. In FIG. 7C, the vacant space occurs in a circle drawn with a dotted line. The vacant space causes disturbance in the formed image such that the image is perceived as including a white stripe by human eyes, for example.

FIG. 8 is a view illustrating a second example of the magnification correction according to the related art.

Figure 8A:
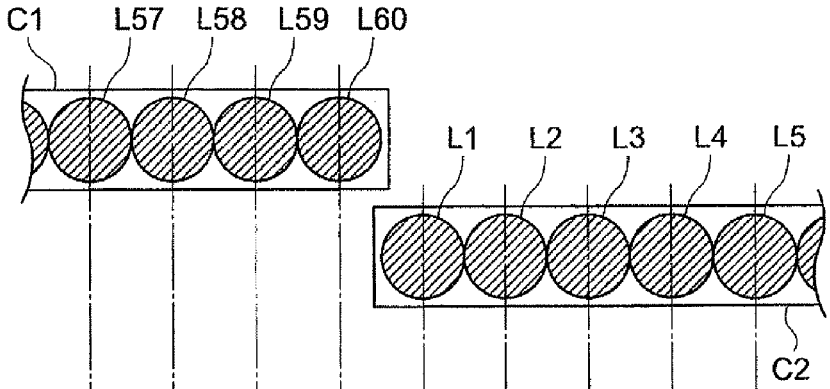
FIG. 8A to 8C are views illustrating a second example of the magnification correction according to the related art.
Figure 8B:
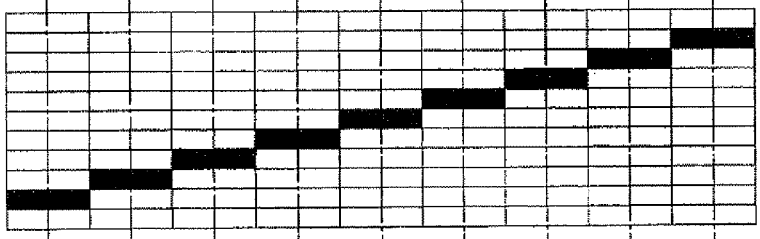
Figure 8C:
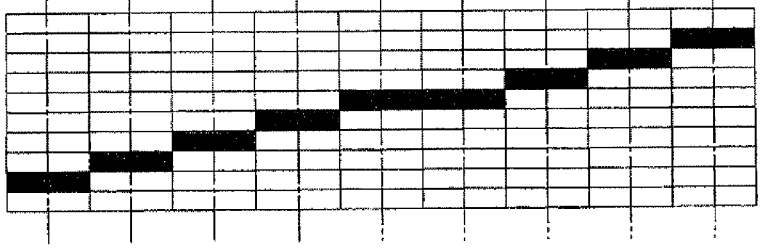

In FIGS. 8A to 8C, a case where a diagonal image is formed is taken as an example. Here, a method of performing magnification correction by scaling the image up in the main scan direction when the magnification in the main scan direction has decreased will be described. FIG. 8B conceptually shows an image before the magnification correction, similarly to FIG. 7B. In FIG. 8C, an image after the magnification correction is conceptually shown. Also, FIG. 8C shows the light emitting thyristors L forming the images of FIGS. 8B and 8C corresponding to the images, similarly to FIG. 7A.

Here, FIG. 8C shows a case where one lighting datum has been added for performing the magnification correction. In this case, it is possible to scale a formed image up in the main scan direction based on the added datum. In other words, it is possible to perform the magnification correction to scale the formed image up in the main scan direction. Meanwhile, in this case, since the added lighting datum is the same as a lighting datum for any one of light emitting thyristors L before and after a light emitting thyristor L corresponding to the added datum, dots corresponding to that portion in the drawn image are consecutive. Therefore, disturbance occurs in the formed image such that the image is perceived as including a black stripe by human eyes, for example.

In this embodiment, in order to suppress the phenomena described with FIGS. 7A to 7C and 8A to 8C, the light emitting chip C in which the light emitting thyristors L are disposed to have the following structure is used.

Figure 9A:
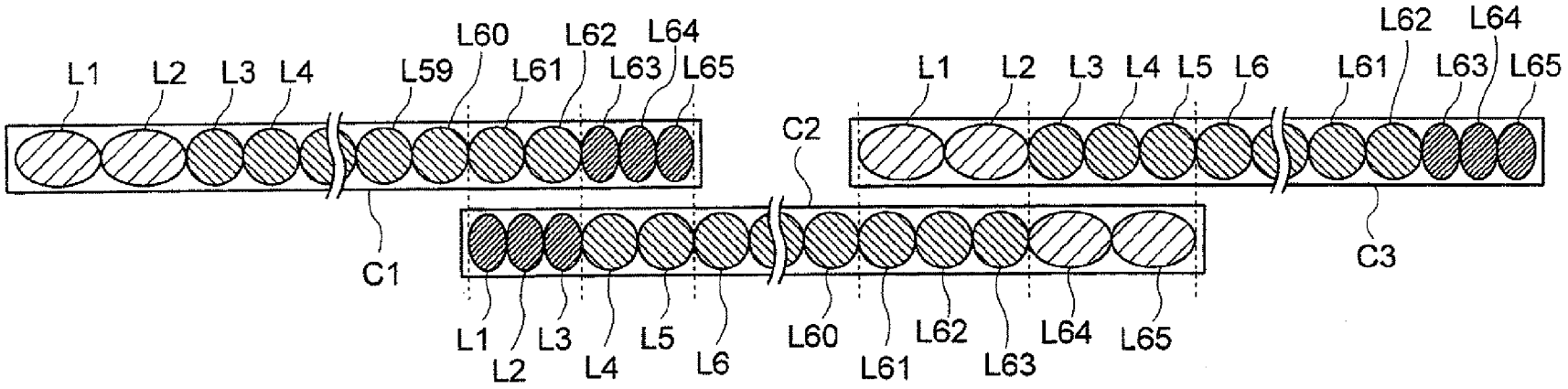
FIGS. 9A and 9B are views illustrating examples of the arrangement of light emitting thyristors of the light emitting chips used in the exemplary embodiment.
Figure 9B:
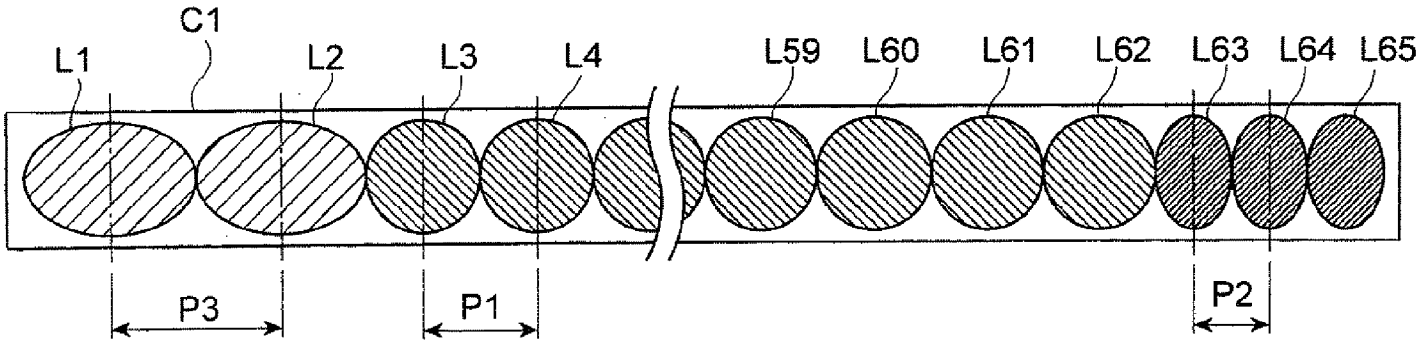

FIGS. 9A and 9B are views illustrating an example of the arrangement of the light emitting thyristors L of the light emitting chips C used in the exemplary embodiment.

Referring to FIG. 9A, the arrangement of the light emitting thyristors L of the light emitting chips C and the arrangement of the light emitting chips C will be described. In FIG. 9A, the border between the light emitting chip C1 and the light emitting chip C2 and the border between the light emitting chip C2 and the light emitting chip C3 are illustrated. The same relationship is repeated among the other light emitting chips C, so as to form a pattern.

As shown in FIG. 9A, in each of the light emitting chips C1, C2, and C3, the light emitting thyristors L1 to L65 are disposed. First, as for the light emitting chips C1 and C3, the light emitting thyristors L3 to L62 are consecutively disposed at a predetermined first interval so as to form a first light emitting element group, for example. The light emitting thyristors L1 and L2 and the light emitting thyristors L63 to L65 are disposed on both end portions of the first light emitting element group in the main scan direction at intervals different from the first interval (a pitch P1 in FIG. 9B), so as to form a second light emitting group, for example. In the second light emitting group, the light emitting thyristors L63 to L65 are disposed on one side of the end portions of the light emitting thyristors L3 to L62 in the main scan direction at a second interval (a pitch P2 in FIG. 9B) narrower than the first interval. The light emitting thyristors L1 and L2 are disposed on the other side of the end portions of the light emitting thyristors L3 to L62 in the main scan direction at a third interval (a pitch P3 in FIG. 9B) wider than the first interval.

Also, the light emitting chip C2 uses the basically same configuration as the light emitting chips C1 and C3; however, the light emitting thyristors L1 to L65 are arranged in the reverse order of the light emitting chips C1 and C3. In other words, the light emitting chip C2 has the same configuration as that obtained by rotating the light emitting chips C1 and C3 180 degrees.

The light emitting thyristors L1 to L65 of the light emitting chips C1, C2, and C3 are disposed to partially overlap in the sub scan direction. In this embodiment, the light emitting thyristors L61 to L65 of the light emitting chip C1 are disposed to overlap the light emitting thyristors L1 to L5 of the light emitting chip C2 in the sub scan direction. Further, the light emitting thyristors L61 to L65 of the light emitting chip C2 are disposed to overlap the light emitting thyristors L1 to L5 of the light emitting chip C3 in the sub scan direction. In two light emitting chips C disposed to overlap each other, overlapping light emitting thyristors L of one of the two light emitting chip C and overlapping light emitting thyristors L of the other light emitting chip C are disposed in a predetermined integer ratio. In this embodiment, the light emitting thyristors L61 and L62 of the light emitting chip C1 and the light emitting thyristors L1 to L3 of the light emitting chip C2 are disposed such that a length in the main scan direction which the light emitting thyristors L61 and L62 of the light emitting chip C1 occupy is almost the same as a length in the main scan direction which the light emitting thyristors L1 to L3 of the light emitting chip C2 occupy. In this case, the predetermined integer ratio is 2:3. Similarly, the light emitting thyristors L63 to L65 of the light emitting chip C1 and the light emitting thyristors L4 and L5 of the light emitting chip C2 are disposed in an integer ratio of 3:2, the light emitting thyristors L61 to L63 of the light emitting chip C2 and the light emitting thyristors L1 and L2 of the light emitting chip C3 are disposed in an integer ratio of 3:2, and the light emitting thyristors L64 and L65 of the light emitting chip C2 and the light emitting thyristors L3 to L5 of the light emitting chip C3 are disposed in an integer ratio of 2:3. It can be seen that, when the light emitting chips C are disposed in zigzag, the configuration in which the light emitting thyristors L are disposed as described above includes a first light emitting element row composed of the light emitting thyristors L disposed in a row in the main scan direction, and a second light emitting element row composed of the light emitting thyristors L disposed in a row in the main scan direction to at least partially overlap the first light emitting element row. In this case, the interval between the light emitting thyristors L of the first light emitting element row and the light emitting thyristors L of the second light emitting element row vary in overlapping portions of the first light emitting element row and the second light emitting element row. In each of the overlapping portions of the first light emitting element row and the second light emitting element row, the light emitting thyristors L of the first light emitting element row and the light emitting thyristors L of the second light emitting element row are disposed in the predetermined integer ratio.

Next, an example of an operation of the light emitting thyristors L of the light emitting chips C disposed in this configuration will be described.

Figure 10:
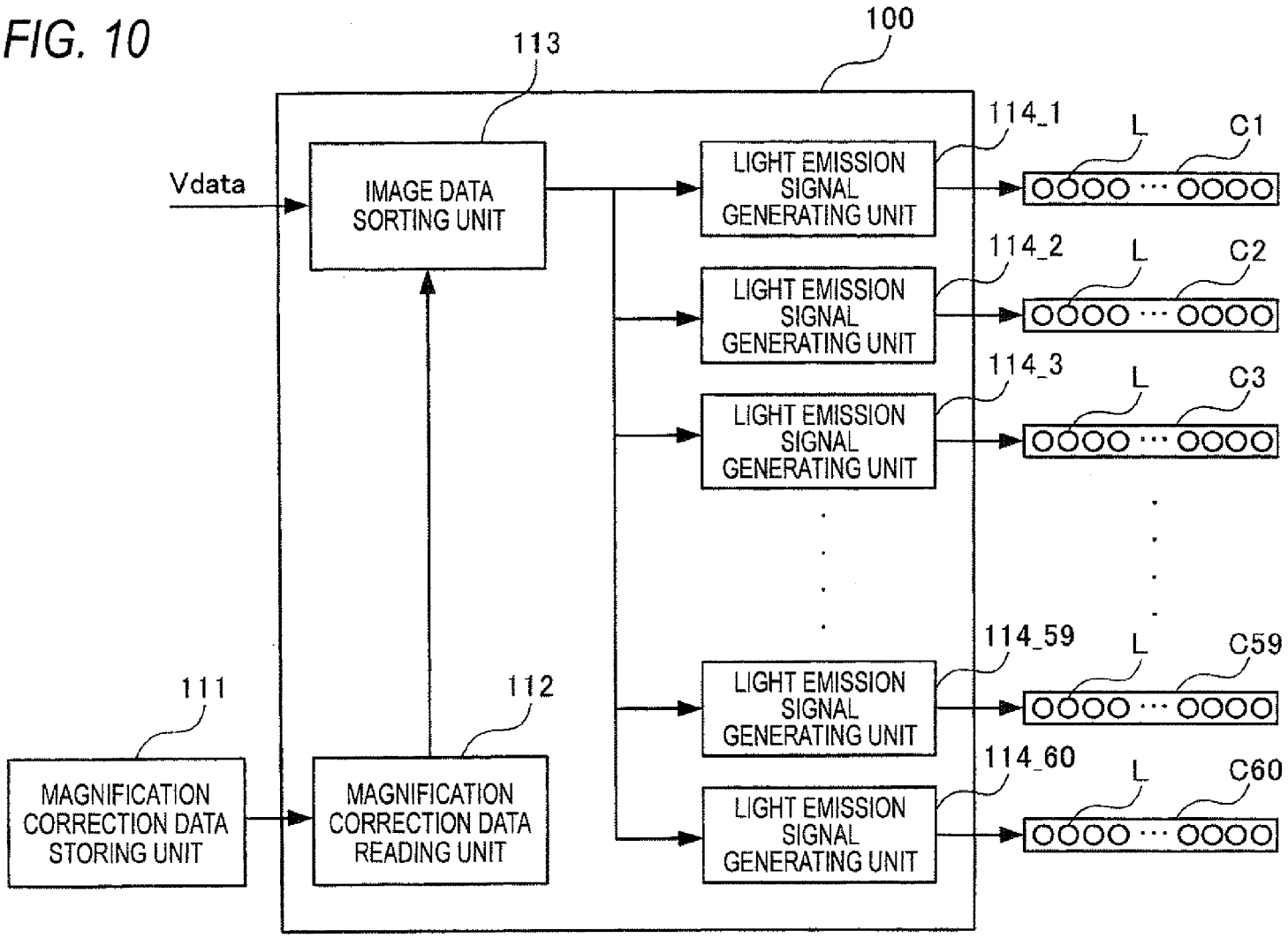
FIG. 10 is a view illustrating a signal generating circuit for driving the light emitting thyristors of the light emitting chips.

FIG. 10 is a view illustrating the signal generating circuit 100 for driving the light emitting thyristors L of the light emitting chips C.

The signal generating circuit 100 shown in FIG. 10 includes a magnification correction data reading unit 112 for reading magnification correction data from a magnification correction data storing unit 111 that stores the magnification correction data for correcting the magnification, if needed, an image data sorting unit 113 for sorting the image data Vdata input as a serial signal, and light emission signal generating units 114_1 to 114_60 for receiving driving signals transmitted as parallel signals from the image data sorting unit 113 and generating light emission signals for driving the light emitting thyristors L of the light emitting chips C (C1 to C60), respectively.

In the image data sorting unit 113, when sorting the image data, in order for the light emitting thyristors L in a portion where the light emitting thyristors L of the light emitting chips C overlap in the sub scan direction to emit light, lighting data are input into the overlapping light emitting thyristors L in any one row, and blank data are input into the overlapping light emitting thyristors L in the other row. Therefore, in the overlapping portion, the light emitting thyristors L of any one light emitting chip C are lightened. From this, it can be seen that, when the light emitting chips C are disposed in zigzag such that the light emitting thyristors L are disposed in two rows of the first light emitting element row and the second light emitting element row, the signal generating circuit 100 selects either the light emitting thyristors L of the first light emitting element row or the light emitting thyristors L of the second light emitting element row from the light emitting thyristors L in the overlapping portion of the first light emitting element row and the second light emitting element row, and controls the selected light emitting thyristors L to emit light.

Next, an image formed when the light emitting thyristors L are controlled to be lighted as described above will be described.

Figure 11A:
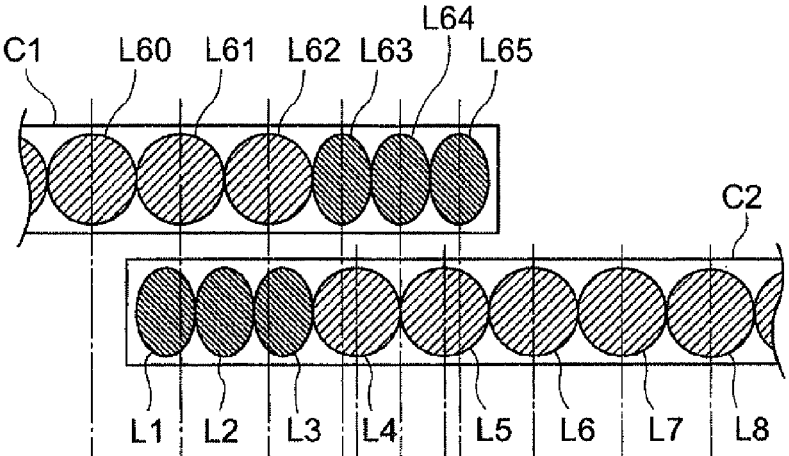
FIGS. 11A to 11C are views illustrating a first example of magnification correction according to the exemplary embodiment.
Figure 11B:
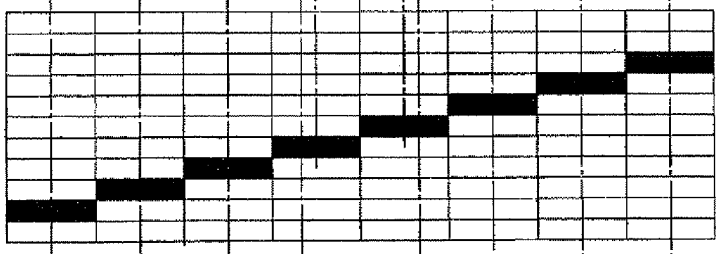
Figure 11C:
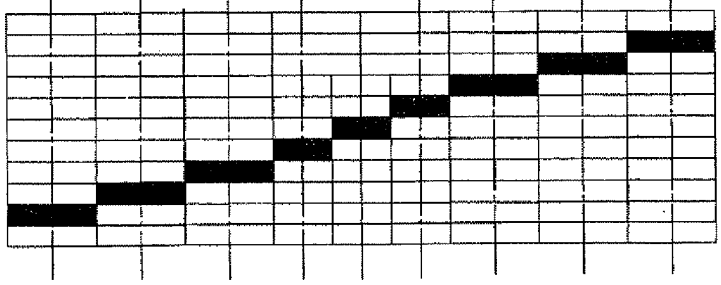

FIGS. 11A to 11C are views illustrating a first example of the magnification correction according to the exemplary embodiment.

Similarly to FIGS. 7A to 7C, in FIGS. 11A to 11C, a case where a diagonal image is formed is taken as an example. Here, a method of performing magnification correction by scaling the image down in the main scan direction when the magnification in the main scan direction has increased will be described. FIG. 11B conceptually shows an image before the magnification correction, similarly to FIG. 7B. In FIG. 11C, an image after the magnification correction of this embodiment is conceptually shown. Also, FIG. 11A shows the light emitting thyristors L forming the images of FIGS. 11B and 11C corresponding to the images. FIG. 11A is an enlarged view of the border between the light emitting chip C1 and the light emitting chip C2 of FIG. 9A.

In this embodiment, among the light emitting thyristors L in the portion where the light emitting chip C1 and the light emitting chip C2 overlap in the sub scan direction, the light emitting thyristors L61 to L65 of the light emitting chip C1 are used and the light emitting thyristors L1 to L5 of the light emitting chip C2 are not used. In other words, in the light emitting chip C2, the light emitting thyristors L1 to L5 are not lightened, and the light emitting thyristor L6 and the subsequent light emitting thyristors L are capable of being lightened. If this is compared to the case described with respect to FIGS. 7A to 7C, it can been seen that, while the light emitting thyristors L1 to L2 of the light emitting chip C2 are used in FIG. 7C, the light emitting thyristors L63 to L65 of the light emitting chip C1 are used in FIGS. 11A to 11C.

Figure 12A:
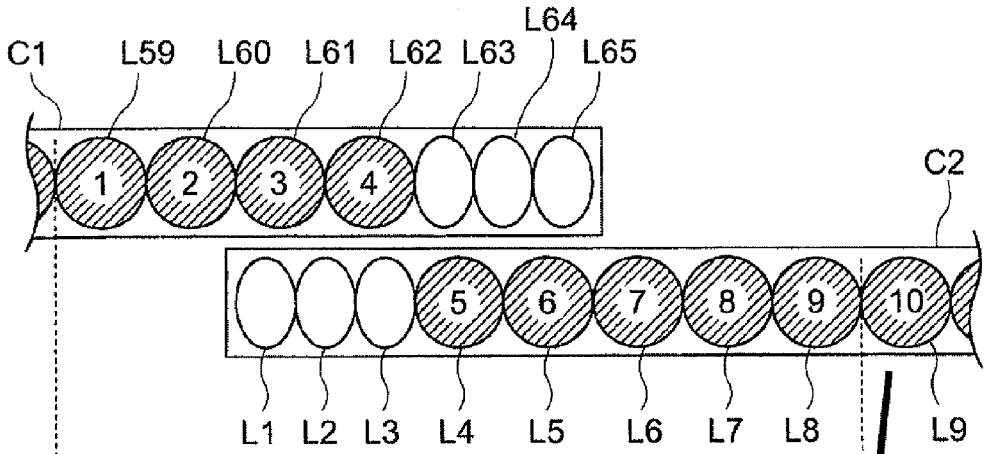
FIGS. 12A and 12B are views illustrating order in which the light emitting thyristors in the border between light emitting chips are lighted.
Figure 12B:
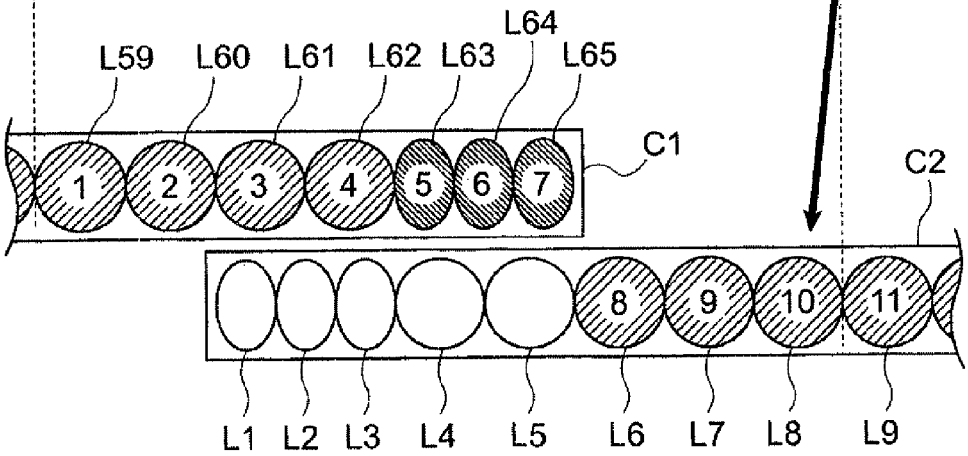

FIG. 12A to 12C are views illustrating order in which the light emitting thyristors L in the border between the light emitting chip C1 and the light emitting chip C2 are lighted. FIG. 12A illustrates order in which the light emitting thyristors L are lighted in a case where any magnification correction is not performed. FIG. 12B illustrates order in which the light emitting thyristors L are lighted in a case where magnification correction is performed. In FIGS. 12A and 12B, numbers in the light emitting thyristors L represent the lighting order. If FIG. 12A and 12B are compared to each other, it can be seen that the light emitting thyristor L tenthly lighted is shifted to the left side of FIGS. 12A to 12C by one light emitting thyristor L, for example. Therefore, it is possible to decrease the magnification in the main scan direction and light the light emitting thyristors L.

Control for lighting the light emitting thyristors L as described above can be performed to form an image as show in FIG. 11C. In other words, in FIG. 7C described above, if one lighting datum is removed, in a portion where a diagonal line should be normally drawn by three lighting data, a diagonal line is drawn by two lighting data, such that a gap is formed in the formed image. In contrast, in this embodiment, the light emitting thyristors L63 to L65 of the light emitting chip C1 are lighted by the lighting data without removing any light data. Since the interval between the light emitting thyristors L63 to L65 of the light emitting chip C1 is narrower than the interval between the other light emitting thyristors L of the light emitting chip C1, the image formed by using the light emitting thyristors L63 to L65 of the light emitting chip C1 is an image subjected to an decrease in the magnification in the main scan direction. In other words, it is possible to perform the magnification correction to scale the formed image down in the main scan direction. In this embodiment, since any lighting data is not removed, any gap does not occur in the formed image. Therefore, it is possible to suppress image disturbance such as formation of a white strip from occurring in the formed image.

In this embodiment, the magnification correction can be performed in not only the border between the light emitting chip C1 and the light emitting chip C2 but also other portions. In other words, the magnification correction can also be performed in the border between the light emitting chip C3 and the light emitting chip C4, the border between the light emitting chip C5 and the light emitting chip C6, . . . , the border between the light emitting chip C57 and the light emitting chip C58, and the border between the light emitting chip C59 and the light emitting chip C60. Therefore, it is possible to select a border among the light emitting chips C according to a portion desired to be subjected to the magnification correction and a desired degree of the magnification correction, and performs the magnification correction to decrease the magnification in the main scan direction.

In this embodiment, the magnification correction to decreasing the magnification in the main scan direction is performed without using the light emitting thyristors L1 to L3 of the light emitting chip C2; however, the light emitting thyristors L1 to L3 of the light emitting chip C2 may be used. In other words, in the above-mentioned example, the light emitting thyristors L63 to L65 of the light emitting chip C1 are used. However, even when the light emitting thyristors L1 to L3 of the light emitting chip C2 are used, the same result can be achieved. Also, all of the light emitting thyristors L63 to L65 of the light emitting chip C1 and the light emitting thyristors L1 to L3 of the light emitting chip C2 can be used to perform the magnification correction twice the case of using either the light emitting thyristors L63 to L65 of the light emitting chip C1 or the light emitting thyristors L1 to L3 of the light emitting chip C2.

Figure 13A:
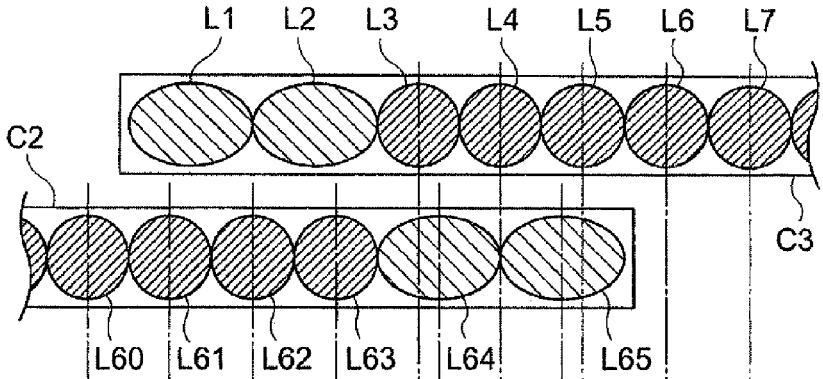
FIGS. 13A to 13C are views illustrating a second example of the magnification correction according to the exemplary embodiment.
Figure 13B:
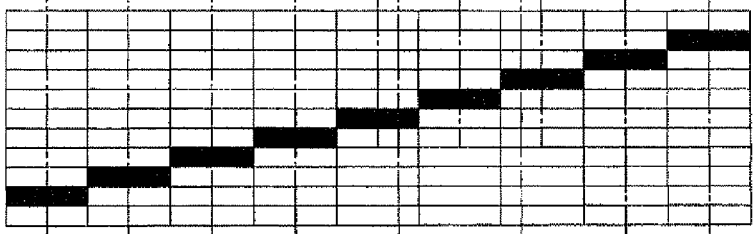
Figure 13C:
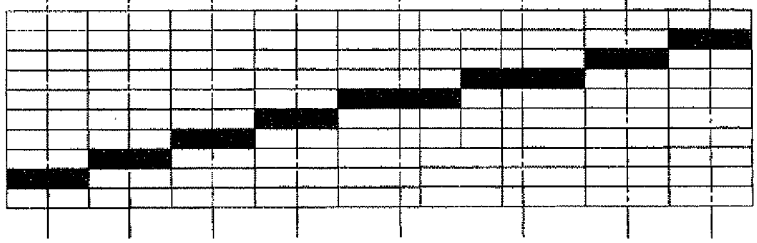

FIGS. 13A to 13C are views illustrating a second example of the magnification correction of the exemplary embodiment.

Similarly to FIGS. 8A to 8C, in FIGS. 13A to 13C, a case where a diagonal image is formed is taken as an example. Here, a method of performing magnification correction by scaling the image up in the main scan direction when the magnification in the main scan direction has decreased will be described. In FIG. 13, (b) conceptually shows an image before the magnification correction, similarly to FIG. 8B. In FIG. 13C, an image after the magnification correction of this embodiment is conceptually shown. Also, FIG. 13A shows the light emitting thyristors L forming the images of FIGS. 13B and 13C corresponding to the images. FIG. 13A is an enlarged view of the border between the light emitting chip C2 and the light emitting chip C3 of FIG. 9A.

In this embodiment, among the light emitting thyristors L in the portion where the light emitting chip C2 and the light emitting chip C3 overlap in the sub scan direction, the light emitting thyristors L64 and L65 of the light emitting chip C2 are used and the light emitting thyristors L1 to L5 of the light emitting chip C3 are not used. In other words, in the light emitting chip C3, the light emitting thyristors L1 to L5 are not lightened, and the light emitting thyristor L6 and the subsequent light emitting thyristors L are capable of being lightened. If this is compared to the case described with respect to FIG. 8, it can been seen that, while the light emitting thyristors L1 to L3 of the light emitting chip C2 are used in FIG. 8C, the light emitting thyristors L64 and L65 of the light emitting chip C2 are used in FIG. 13.

Figure 14A:
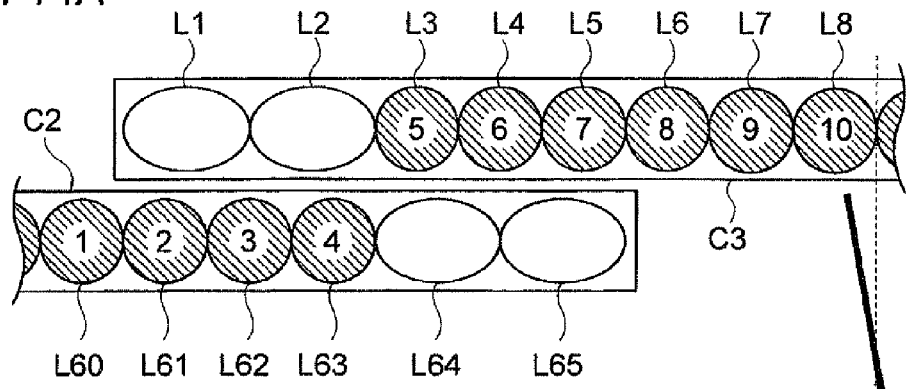
FIGS. 14A and 14B are views illustrating order in which the light emitting thyristors in the border between light emitting chips are lighted.
Figure 14B:
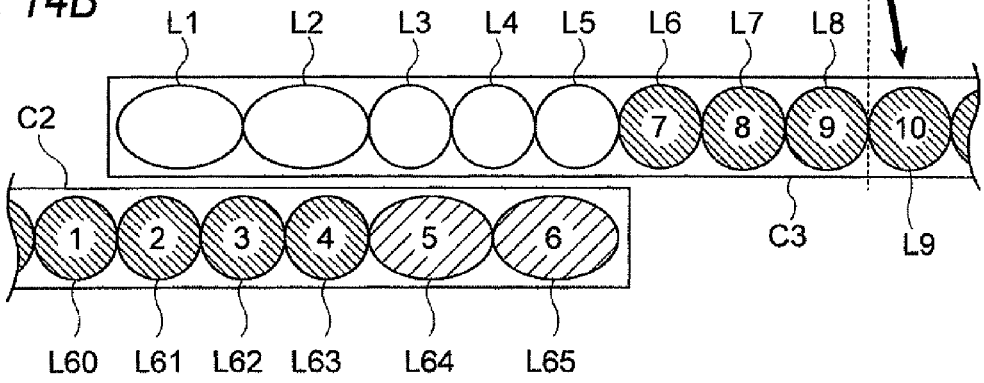

FIGS. 14A to 14C are views illustrating order in which the light emitting thyristors in the border between the light emitting chip C2 and the light emitting chip C3 are lighted. FIG. 14A illustrates order in which the light emitting thyristors L are lighted in a case where any magnification correction is not performed. FIG. 14B illustrates order in which the light emitting thyristors L are lighted in a case where magnification correction is performed. In FIGS. 14A and 14B, numbers in the light emitting thyristors L represent the lighting order. If FIGS. 14A and 14B are compared to each other, it can be seen that the light emitting thyristor L tenthly lighted is shifted to the right side of FIGS. 14A to 14C by one light emitting thyristor L. Therefore, it is possible to increase the magnification in the main scan direction and light the light emitting thyristors L.

Control for lighting the light emitting thyristors L as described above can be performed to form an image as show in FIG. 13C. In other words, in FIG. 8C described above, if one lighting datum is added, in a portion where a diagonal line should be normally drawn by three lighting data, a diagonal line is drawn by two lighting data, such that portions where overlapping dots are drawn occur in the formed image. In contrast, in this embodiment, the light emitting thyristors L64 and L65 of the light emitting chip C2 are lighted by the lighting data without adding any light data. Since the interval between the light emitting thyristors L64 and L65 of the light emitting chip C2 is wider than the interval between the other light emitting thyristors L of the light emitting chip C2, the image formed by using the light emitting thyristors L64 and L65 of the light emitting chip C2 is an image subjected to an increase in the magnification in the main scan direction. In other words, it is possible to perform the magnification correction to scale the formed image up in the main scan direction. In this embodiment, since any lighting data is not added, any overlapping portion does not occur in the formed image. Therefore, it is possible to suppress image disturbance such as formation of a black strip from occurring in the formed image.

In this embodiment, the magnification correction can be performed in not only the border between the light emitting chip C2 and the light emitting chip C3 but also other portions. In other words, the magnification correction can also be performed in the border between the light emitting chip C4 and the light emitting chip C5, the border between the light emitting chip C6 and the light emitting chip C7, . . . , the border between the light emitting chip C56 and the light emitting chip C57, and the border between the light emitting chip C58 and the light emitting chip C59. Therefore, it is possible to select a border among the light emitting chips C according to a portion desired to be subjected to the magnification correction and a desired degree of the magnification correction, and performs the magnification correction to increase the magnification in the main scan direction.

In this embodiment, the magnification correction to increasing the magnification in the main scan direction is performed without using the light emitting thyristors L1 to L2 of the light emitting chip C3; however, the light emitting thyristors L1 to L2 may be used. In other words, in the above-mentioned example, the light emitting thyristors L64 and L65 of the light emitting chip C2 are used. However, even when the light emitting thyristors L1 and L2 of the light emitting chip C3 are used, the same result can be achieved. Also, all of the light emitting thyristors L64 and L65 of the light emitting chip C2 and the light emitting thyristors L1 and L2 of the light emitting chip C3 can be used to perform the magnification correction twice the case of using either the light emitting thyristors L64 and L65 of the light emitting chip C2 or the light emitting thyristors L1 and L2 of the light emitting chip C3.

Since the light emitting chips C in which the light emitting thyristors L are arranged as described above are used, requests for the accuracy of the attachment of the light emitting chips C, the accuracy of the formation of the light emitting thyristors in each light emitting chip C, and the degree of a variation in the focus position of the rod lens array 64 (see FIG. 2) are further reduced. In other words, the light emitting element head 14 (see FIG. 2) may be inspected after the fabrication and the magnification correction may be performed in response to the inspection result, thereby manufacturing the light emitting element heads 14 having a small variation in the magnification in the main scan direction. Therefore, it is possible to further increase the manufacturing yield of the light emitting chips C and the light emitting element head 14.

Moreover, as for a variation in the magnification in the main scan direction caused by a change in the temperature, for example, the magnification correction may be performed corresponding to the temperature in the light emitting element head and the like, thereby providing the light emitting element head 14 having a smaller variation in the magnification in the main scan direction.

Making the amount of light from each of the light emitting thyristors L increasing according to the spacing between the thyristors is preferable. Specifically, with reference to FIG. 9B, the amount of light from each of the light emitting thyristors L63 to L65 is made smaller than the amount of light from each the light emitting thyristors L3 to L62 because the light emitting thyristors L63 to L65 are placed with the pitch P2 which is smaller than the pitch P1 with which the light emitting thyristors L3 to L62 are placed. On the other hand, the amount of light from each of the light emitting thyristors L1 to L2 is made larger than the amount of light from each the light emitting thyristors L3 to L62 because the light emitting thyristors L1 to L2 are placed with the pitch P3 which is larger than the pitch P1 with which the light emitting thyristors L3 to L62 are placed. By this means, the degree of a variation of the light from the thyristors L in the main scan direction are further reduced and more even light output is obtained. In other words, the dependency of the amount of light output from the thyristors L on the space between the thyristors L is cut out.

In order to implement the above thyristors L, the area of light emitting region may be set in accordance with the space between the thyristors L. The area of light emitting region may be set smaller in accordance with the space when the space is smaller. Also, the area may be set larger in accordance with the space when the space is larger.

Another way of saying, the amount of light of each of the thyristors L which is placed with the second pitch (P2) is smaller than the amount of light of each of the thyristors L which is placed with the first pitch (P1) and the amount of light of each of the thyristors L which is placed with the third pitch (P3) is larger than the amount of light of each of the thyristors L which is placed with the first pitch (P1).

Figure 15:
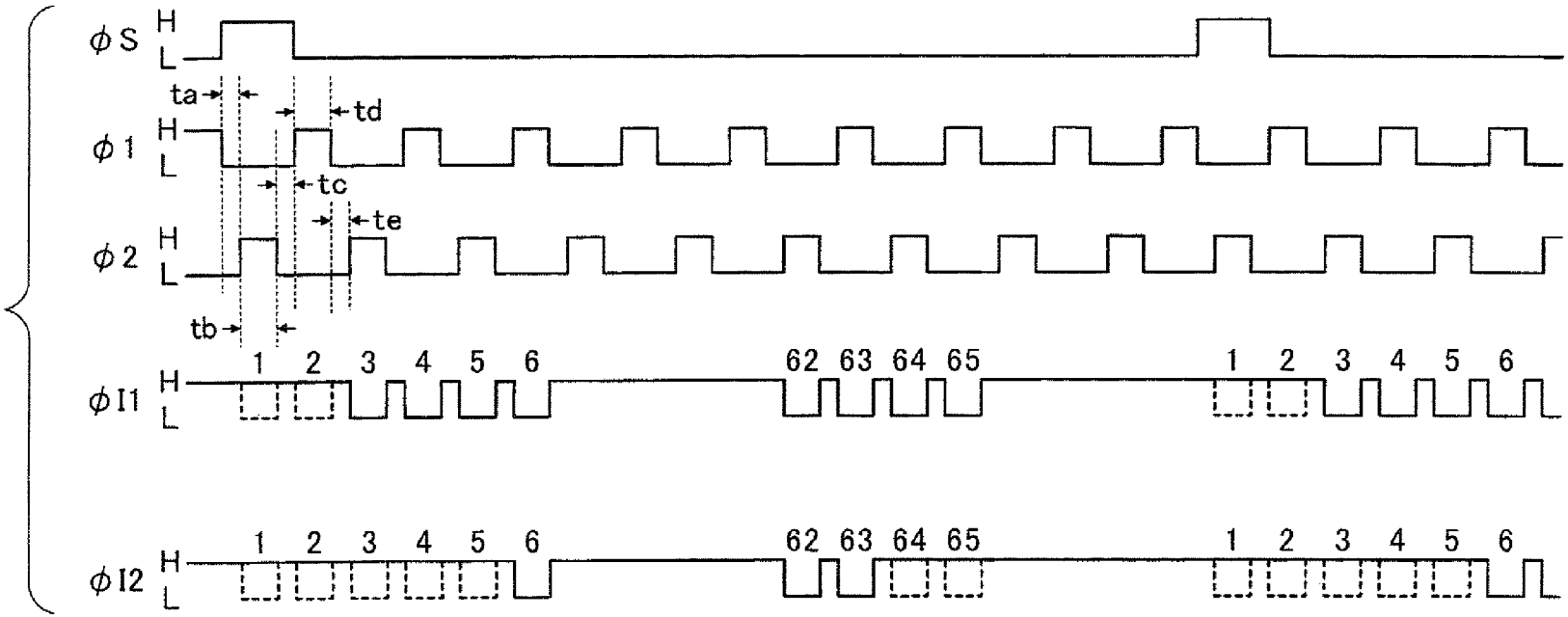
FIG. 15 is a view illustrating a timing chart.

Next, an operation of the light emitting chips C at an exposure operation will be described with reference to FIG. 15. FIG. 15 shows an example of a timing chart for lighting the light emitting thyristors L when the magnification correction is performed by scaling the image down in the main scan direction as described with respect to FIGS. 11A to 11C and FIGS. 12A to 12C. Here, for ease of explanation, a case where the light emitting thyristors L are sequentially lighted in the main scan direction will be described. The lighting pattern of the light emitting thyristors L is the same as that in the case described with respect to FIG. 12B.

In FIG. 15, the light emission signals ϕI1 to ϕI2 are shown as the light emission signals ϕI of the light emitting chips C1 and C2. In order to make the description understandable, the light emission signals ϕI1 and ϕI2 are shown in parallel. However, the light emission signals ϕI1 and ϕI2 are not necessarily transmitted with temporal simultaneity.

Here, it is assumed that, in an initial state, the start transmission signal ϕS is set at the low level L, the first transmission signal ϕ1 is set at the high level H, the second transmission signal ϕ2 is set at the low level L, and the light emission signals ϕI (ϕI1 and ϕI2) are set at the high level H.

With the start of the operation, the start transmission signal ϕS input from the signal generating circuit 100 transitions from the low level to the high level. Therefore, the start transmission signal ϕS of the high level is supplied to the gate terminals G1 of the transmission thyristors S1 of the light emitting chips C. At this time, the start transmission signal ϕS is also supplied to the gate terminals G2 to S65 of the other transmission thyristors S2 to S65 through the diodes D1 to D64. However, since a voltage drop occurs in each of the diodes D1 to D64, a voltage on the gate terminal G1 of the transmission thyristor S1 is the highest.

In the state in which the start transmission signal ϕS is at the high level, the first transmission signal ϕ1 input from the signal generating circuit 100 transitions from the high level to the low level. When a first period to elapses after the first transmission signal ϕ1 transitions to the low level, the second transmission signal ϕ2 transitions from the low level to the high level.

In the state in which the start transmission signal ϕS is at the high level, if the first transmission signal ϕ1 of the low level is supplied, in the light emitting chip C, among the odd-numbered transmission thyristors S1, S3, . . . , and S65 receiving the first transmission signal ϕ1 of the low level, the transmission thyristor S1 whose gate voltage is the highest and is a threshold value or greater is turned on. At this time, since the second transmission signal ϕ2 is at the high level, the cathode voltages of the even-numbered transmission thyristors S2, S4, . . . , and S64 are high such that the ON state is maintained. At this time, in the light emitting chip C, only the odd-numbered transmission thyristor S1 becomes an ON state. Therefore, the light emitting thyristor L1 whose gate is connected to the gate of the odd-numbered transmission thyristor S1 is turned on to be in a state in which light emission is possible.

In the state where the transmission thyristor S1 is in the ON state, when a second period tb elapses after the second transmission signal ϕ2 transitions to the high level, the second transmission signal ϕ2 transitions form the high level to the low level. Then, among the even-numbered transmission thyristors S2, S4, . . . , and S64 receiving the second transmission signal ϕ2 of the low level, the transmission thyristor S2 whose gate voltage is the highest and is a threshold value or greater is turned on. At this time, in the light emitting chip C, all of the odd-numbered transmission thyristor S1 and the even-numbered transmission thyristor S2 adjacent to the odd-numbered transmission thyristor S1 become the ON state. Therefore, in addition to the light emitting thyristor L1 that has been already turned on, the light emitting thyristor L2 whose gate is connected to the gate of the even-numbered transmission thyristor S2 is turned on, such that all of the light emitting thyristors L1 and L2 are in a state in which light emission is possible.

In the state where all of the transmission thyristor S1 and the transmission thyristor S2 are in the ON state, when a third period tc elapses after the second transmission signal ϕ2 transitions to the low level, the first transmission signal ϕ1 transitions from the low level to the high level. Therefore, the odd-numbered transmission thyristor S1 is turned off, and only the even-numbered transmission thyristor S2 is in the ON state. Therefore, the odd-numbered light emitting thyristor L1 is turned off to be in a state in which light emission is impossible, and only the even-numbered light emitting thyristor L2 maintains the ON state to be in a state in which light emission is possible. In this example, when the first transmission signal ϕ1 transitions to the high level, the start transmission signal ϕS transitions from the high level to the low level.

In the state where the transmission thyristor S2 is in the ON state, when a fourth period td elapses after the first transmission signal ϕ1 transitions to the high level, the first transmission signal ϕ1 transitions form the high level to the low level. Then, among the odd-numbered transmission thyristors S1, S3, . . . , and S65 receiving the first transmission signal ϕ1 of the low level, the transmission thyristor S3 whose gate voltage is the highest is turned on. At this time, in the light emitting chip C, since all of the even-numbered transmission thyristor S2 and the odd-numbered transmission thyristor S3 adjacent to the even-numbered transmission thyristor S2 become the ON state. Therefore, in addition to the light emitting thyristor L2 that has been already turned on, the light emitting thyristor L3 whose gate is connected to the gate of the odd-numbered transmission thyristor S3 is turned on, such that all of the light emitting thyristors L2 and L3 are in a state in which light emission is possible.

In the state where all of the transmission thyristor S2 and the transmission thyristor S3 are in the ON state, when a fifth period to elapses after the first transmission signal ϕ1 transitions to the low level, the second transmission signal ϕ2 transitions from the low level to the high level. Therefore, the even-numbered transmission thyristor S2 is turned off, and only the odd-numbered transmission thyristor S3 is in the ON state. Therefore, the even-numbered light emitting thyristor L2 is turned off to be in a state in which light emission is impossible, and only the odd-numbered light emitting thyristor L3 maintains the ON state to be in a state in which light emission is possible.

As described above, in the light emitting chip C, the first transmission signal ϕ1 and the second transmission signal ϕ2 are alternately switched between the high level and low level while overlapping periods when all of the first transmission signal ϕ1 and the second transmission signal ϕ2 are set at the low level are provided, such that the transmission thyristors S1 to S65 are sequentially turned on in numerical order. In this case, in the second period tb, only an odd-numbered transmission thyristor (for example, the transmission thyristor S1) is turned on. In the third period tc, the odd-numbered transmission thyristor and an even-numbered transmission thyristor at the next stage (for example, the transmission thyristor S1 and the transmission thyristor S2) are turned on. In the fourth period td, only the even-numbered transmission thyristor (for example, the transmission thyristor S2) is turned on. In the fifth period te, the even-numbered transmission thyristor and an odd-numbered transmission thyristor at the next stage (for example, the transmission thyristor S2 and the transmission thyristor S3) are turned on. Then, in the next second period tb, only the odd-numbered transmission thyristor (for example, the transmission thyristor S3) is turned on. This process is repeated.

Meanwhile, the light emission signals ϕI1 and ϕI2 basically transition from the high level to the low level and from the low level to the high level in the second period tb when only an odd-numbered transmission thyristor is turned on and the fourth period td when only an even-numbered transmission thyristor is turned on.

However, the light emission signal ϕI1 does not transition in periods when two transmission thyristors S1 and S2 at the left end are in the ON state. Therefore, in the light emitting chip C1, the light emitting thyristors L3 to L65 emit light in turns one by one. In other words, in this embodiment, since the light emitting thyristors L1 and L2 for performing the magnification correction by scaling the image up in the main scan direction are not used, the two light emitting thyristors L1 and L2 are controlled so as not to be lighted. Meanwhile, since the light emitting thyristors L63 to L65 for performing the magnification correction by scaling the image down in the main scan direction are used, the light emitting thyristors L63 to and L65 are lighted.

The light emission signal ϕI2 does not transition in periods when five transmission thyristors S1 to S5 at the left end are in the ON state and periods when two transmission thyristors S64 and S65 at the right end are in the ON state. Therefore, in the light emitting chip C2, the light emitting thyristors L6 to L63 emit light in turns one by one. In other words, in this embodiment, since the light emitting thyristors L64 and L65 for performing the magnification correction by scaling the image up in the main scan direction are not used, the two light emitting thyristors L64 and L65 are controlled so as not to be lighted. Meanwhile, since the light emitting thyristors L1 to L3 for performing the magnification correction by scaling the image down in the main scan direction, and the light emitting thyristors L4 and L5 are also not used in this embodiment, the five light emitting thyristors L1 to and L5 are controlled so as not to be lighted.

In this embodiment, the pattern of the arrangement of the light emitting thyristors L is not limited to the above-mentioned example.

FIGS. 16A to 16D are views illustrating other examples of the arrangement pattern of the light emitting thyristors.

Figures 16A, 16B, 16C, 16D:
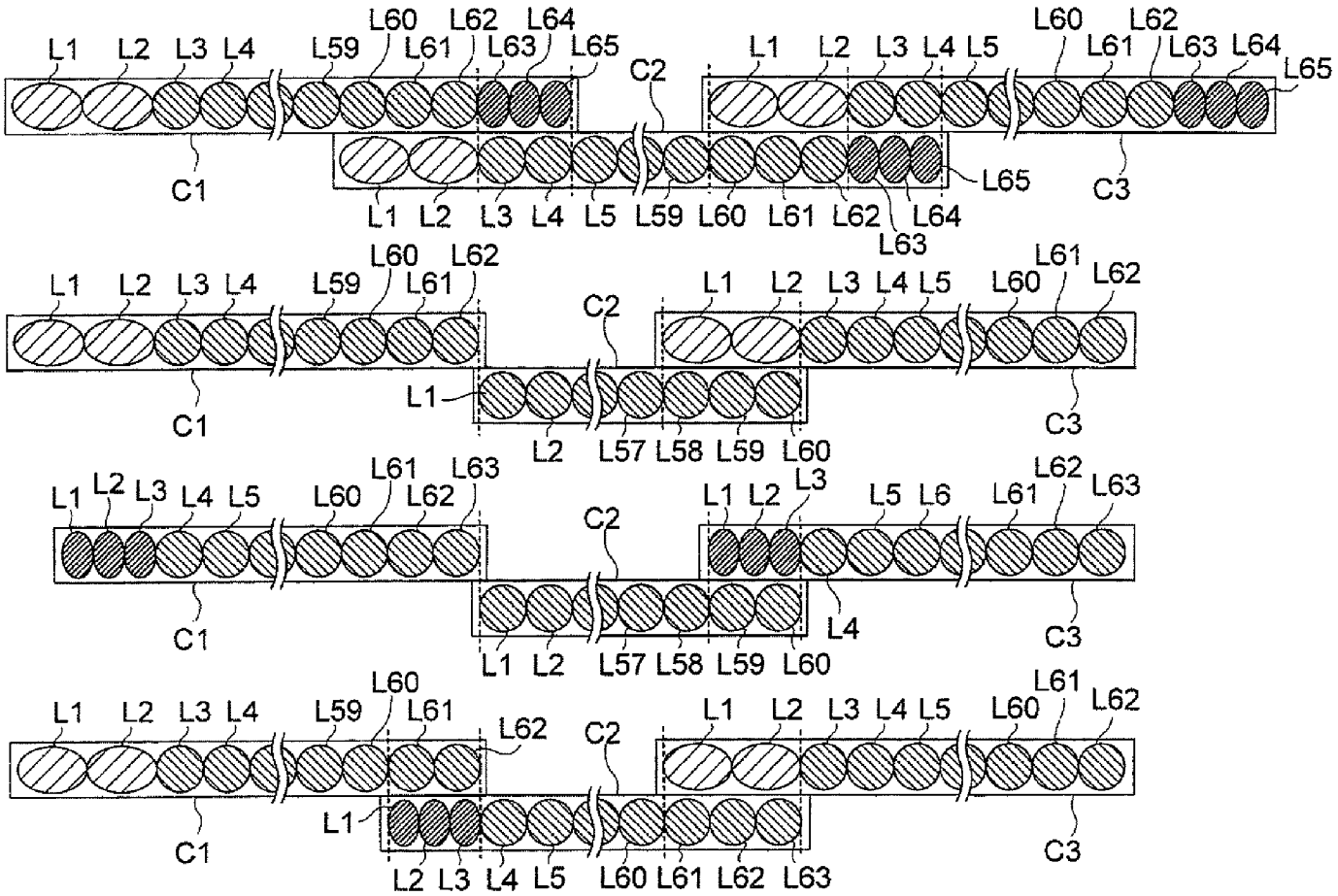
FIGS. 16A to 16D are views illustrating other examples of the arrangement pattern of the light emitting thyristors.

A pattern of the arrangement of the light emitting thyristors L shown in FIG. 16A is the same as that described with respect to FIG. 9A. However, as for a pattern of the arrangement of the light emitting chips C, unlike the case shown in FIG. 9A, all of the even-numbered light emitting chips (the light emitting chip C2 in FIG. 16A) and the odd-numbered light emitting chips (the light emitting chips C1 and C3 in FIG. 16A) are disposed in the same direction. In other words, the even-numbered light emitting chips C are disposed in a direction rotated by 180 degrees, as compared to the case shown in FIG. 9A.

In a case where the light emitting chips C and the light emitting thyristors L are arranged in that way, when the magnification correction is performed to decrease the magnification in the main scan direction, instead of lighting the light emitting thyristors L3 and L4 of each light emitting chip C, the light emitting thyristors L63 to L65 of each light emitting chip C may be controlled to be lighted. Meanwhile, when the magnification correction is performed to increase the magnification in the main scan direction, instead of lighting the light emitting thyristors L60 to L62 of each light emitting chip C, the light emitting thyristors L1 to L2 of each light emitting chip C may be controlled to be lighted.

However, in this embodiment, since the odd-numbered light emitting chips C and the even-numbered light emitting chips C are different from each other, it is necessary to prepare two kinds of light emitting chips C. In other words, although not shown in the drawings, wiring lines connected to the light emitting chips C are disposed on the upper side of the drawing with respect to the odd-numbered light emitting chips C and are disposed on the lower side of the drawing with respect to the even-numbered light emitting chips C. Therefore, in the odd-numbered light emitting chips C and the even-numbered light emitting chips C, the connection directions of the wiring lines are different from each other by 180 degrees. For this reason, it is also necessary that a wiring pattern on the odd-numbered light emitting chips C are different from a wiring pattern on the even-numbered light emitting chips C. Therefore, two kinds of light emitting chips are necessary.

Meanwhile, in the pattern of the light emitting chips C and the light emitting thyristors L shown in FIG. 9A, similarly, the connection directions of the wiring lines in the odd-numbered light emitting chips C and the even-numbered light emitting chips C are different from each other by 180 degrees. However, the odd-numbered light emitting chips C have the same configuration as that when the even-numbered light emitting chips C rotate 180 degrees. Consequently, since it is not necessary to make the pattern of the wiring lines on the odd-numbered light emitting chips C different from the pattern of the wiring lines on the even-numbered light emitting chips C, only one kind of light emitting chips C may be used.

In the pattern of the arrangement of the light emitting thyristors L shown in FIG. 16B, the odd-numbered light emitting chips C (the light emitting chips C1 and C3 in FIG. 16B) have a configuration without the light emitting thyristors L for performing the magnification correction to decrease the magnification in the main scan direction, as compared to the case described with respect to FIG. 9A. Further, the even-numbered light emitting chips C (the light emitting chip C2 in FIG. 16B) do not have not only the light emitting thyristors L for performing the magnification correction to decrease the magnification in the main scan direction but also the light emitting thyristors L for performing the magnification correction to increase the magnification in the main scan direction. In other words, in the odd-numbered light emitting chips C, 62 light emitting thyristors L1 to L62 are disposed. Further, in the even-numbered light emitting chips C, 60 light emitting thyristors L1 to L60 are disposed.

In a case where the light emitting chips C and the light emitting thyristors L are arranged in that way, it is possible to perform the magnification correction to increase the magnification in the main scan direction. However, it is difficult to perform the magnification correction to decrease the magnification in the main scan direction while suppressing disturbance of the image.

The pattern of the arrangement of the light emitting thyristors L shown in FIG. 16C is the same as that in a case where, in the odd-numbered light emitting chips C (the light emitting chips C1 and C3 in FIG. 16C) in FIG. 16B, instead of the light emitting thyristors L for performing the magnification correction to decrease the magnification in the main scan direction, the light emitting thyristors L for performing the magnification correction to increase the magnification in the main scan direction are disposed. In this case, in the odd-numbered light emitting chips C, 63 light emitting thyristors L1 to L63 are disposed. Further, in the even-numbered light emitting chips C, 60 light emitting thyristors L1 to L60 are disposed, similarly to the case of FIG. 16B.

In a case where the light emitting chips C and the light emitting thyristors L are arranged in that way, it is possible to perform the magnification correction to decrease the magnification in the main scan direction. However, it is difficult to perform the magnification correction to increase the magnification in the main scan direction while suppressing disturbance of the image.

The pattern of the arrangement of the light emitting thyristors L shown in FIG. 16D is the same as that in a case where the light emitting thyristors L for the magnification correction disposed at ends in the main scan direction are removed from the pattern described with respect to FIG. 9A. In this case, in the odd-numbered light emitting chips C, 62 light emitting thyristors L1 to L62 are disposed. Further, in the even-numbered light emitting chips C, 63 light emitting thyristors L1 to L63 are disposed.

Even in a case where the light emitting chips C and the light emitting thyristors L are arranged in that way, it is possible to perform the magnification correction to decrease the magnification in the main scan direction and the magnification correction to increase the magnification in the main scan direction.

Even in any cases described with respect to FIGS. 16B to 16D, since the pattern of the arrangement of the light emitting thyristors L of the odd-numbered light emitting chips C is different from the pattern of the arrangement of the light emitting thyristors L of the even-numbered light emitting chips C, two kinds of light emitting chips are necessary.

The light emitting thyristors L do not necessarily partially overlap in the sub scan direction but may completely overlap in the sub scan direction.

Figure 17A:
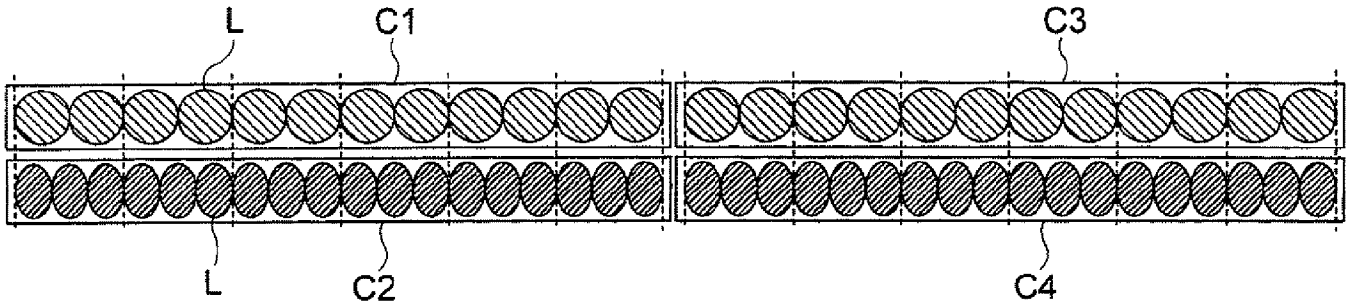
FIGS. 17A to 17C are views illustrating further other examples of the arrangement pattern of the light emitting thyristors.
Figure 17B:
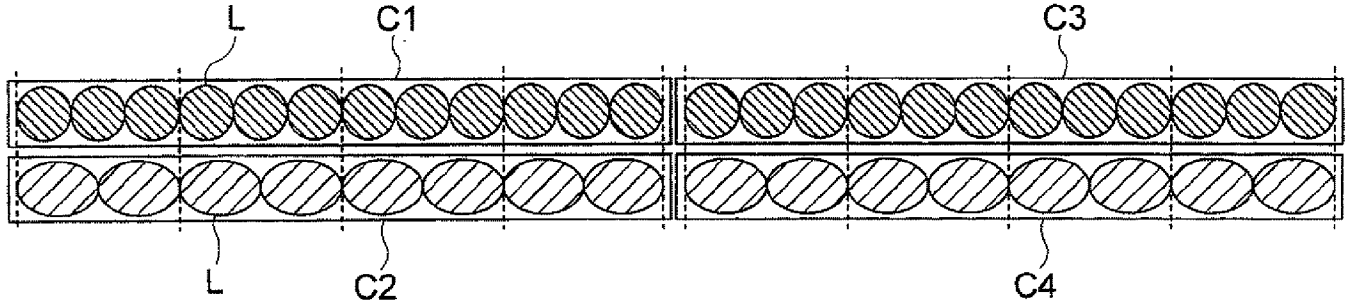
Figure 17C:
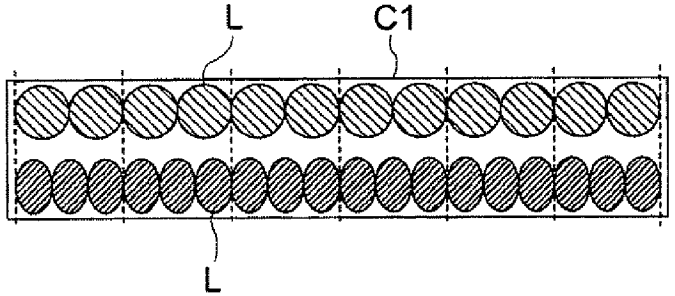

FIGS. 17A to 17C are views illustrating further other examples of the arrangement pattern of the light emitting thyristors.

In FIG. 17A, the light emitting thyristors L of the odd-numbered light emitting chips C (the light emitting chips C1 and C3 in FIG. 17A) completely overlap the light emitting thyristors L of the even-numbered light emitting chips C (the light emitting chips C2 and C4 in FIG. 17A). The interval between the light emitting thyristors L of the even-numbered light emitting chips C is narrower than the interval between the light emitting thyristors L of the odd-numbered light emitting chips C. Therefore, it is possible to perform the magnification correction to decrease the magnification in the main scan direction.

Similarly to the case of FIG. 17A, in FIG. 17B, the light emitting thyristors L of the odd-numbered light emitting chips C (the light emitting chips C1 and C3 in FIG. 17A) completely overlap the light emitting thyristors L of the even-numbered light emitting chips C (the light emitting chip C2 and C4 in FIG. 17A). Meanwhile, the interval between the light emitting thyristors L of the even-numbered light emitting chips C is wider than the interval between the light emitting thyristors L of the odd-numbered light emitting chips C. Therefore, it is possible to perform the magnification correction to increase the magnification in the main scan direction.

It is not necessarily required that two light emitting chips C are disposed such that the light emitting thyristors L of one light emitting chip C at least partially overlap the light emitting thyristors L of the other light emitting chip C. The light emitting thyristors L may be disposed in two rows on one light emitting chip C.

FIG. 17C shows an example in which the light emitting thyristors L may be disposed in two rows on one light emitting chip C1.

Here, the interval between the light emitting thyristors L in the lower row in FIG. 17C is narrower than the interval between the light emitting thyristors L in the upper row in FIG. 17C. Therefore, it is possible to perform the magnification correction to decrease the magnification in the main scan direction.

In the light emitting chips C described with respect to FIGS. 9A and 9B and so on, the magnification correction is possible only in the borders between the light emitting chips C. However, in the light emitting chips C of FIGS. 17A to 17C, the magnification correction is possible in not only the borders between the light emitting chips C but also other portions.

The integer ratio of the numbers of the light emitting thyristors L disposed to overlap in the sub scan direction is 2:3 or 3:2 in the above-mentioned examples, but is not limited thereto.

Figure 18:
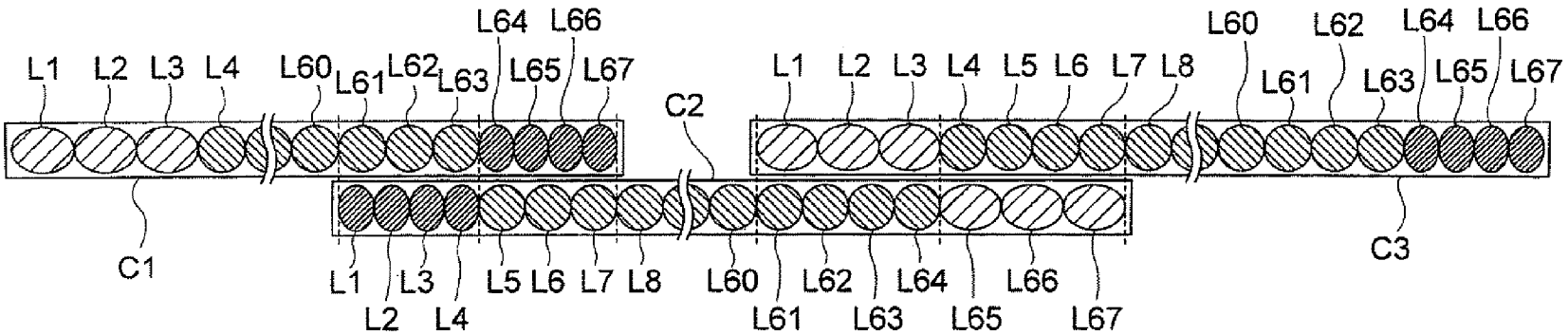
FIG. 18 is a view illustrating a case where 3:4 or 4:3 is used as an integer ratio of the numbers of the light emitting thyristors disposed to overlap each other in a sub scan direction.

FIG. 18 is a view illustrating a case where 3:4 or 4:3 is used as an integer ratio of the numbers of the light emitting thyristors disposed to overlap each other in a sub scan direction.

As shown in FIG. 18, in each of the light emitting chips C1, C2, and C3, light emitting thyristors L1 to L67 are disposed. First, as for the light emitting chips C1 and C3, the light emitting thyristors L4 to L63 are consecutively disposed at a predetermined first interval so as to form a first light emitting element group, for example. The light emitting thyristors L1 to L3 and the light emitting thyristors L64 to L67 are disposed on both end portions of the first light emitting element group in the main scan direction at intervals different from the first interval, so as to form a second light emitting group, for example. In the second light emitting group, the light emitting thyristors L64 to L67 are disposed on one side of the both end portions of the light emitting thyristors L4 to L63 in the main scan direction at a second interval narrower than the first interval. Further, the light emitting thyristors L1 to L3 are disposed on the other side of the both end portions of the light emitting thyristors L4 to L63 in the main scan direction at a third interval wider than the first interval.

Also, the light emitting chip C2 uses the basically same configuration as the light emitting chips C1 and C3; however, the light emitting thyristors L1 to L67 are arranged in the reverse order of the light emitting chips C1 and C3. In other words, the light emitting chip C2 has the same configuration as that obtained by rotating the light emitting chips C1 and C3 180 degrees.

In this embodiment, the light emitting thyristors L61 to L67 of the light emitting chip C1 are disposed to overlap the light emitting thyristors L1 to L7 of the light emitting chip C2 in the sub scan direction. Further, the light emitting thyristors L61 to L67 of the light emitting chip C2 are disposed to overlap the light emitting thyristors L1 to L7 of the light emitting chip C3 in the sub scan direction. In this embodiment, the light emitting thyristors L61 to L63 of the light emitting chip C1 and the light emitting thyristors L1 to L4 of the light emitting chip C2 are disposed such that a length in the main scan direction which the light emitting thyristors L61 to L63 of the light emitting chip C1 occupy is almost the same as a length in the main scan direction which the light emitting thyristors L1 to L4 of the light emitting chip C2 occupy. In this case, the predetermined integer ratio is 3:4. Similarly, the light emitting thyristors L64 to L67 of the light emitting chip C1 and the light emitting thyristors L5 to L7 of the light emitting chip C2 are disposed in an integer ratio of 4:3, the light emitting thyristors L61 to L64 of the light emitting chip C2 and the light emitting thyristors L1 to L3 of the light emitting chip C3 are disposed in an integer ratio of 4:3, and the light emitting thyristors L65 to L67 of the light emitting chip C2 and the light emitting thyristors L4 to L7 of the light emitting chip C3 are disposed in an integer ratio of 3:4.

Even in the light emitting chips C in which the light emitting thyristors L are arranged in that way, it is possible to select either the light emitting thyristors L in one row or the light emitting thyristors L in the other row from the light emitting thyristors L in the overlapping portion of the two rows, and control the selected light emitting thyristors L to emit light, thereby performing the magnification correction in the main scan direction.

However, in the case of those light emitting chips C, the number of the light emitting thyristors L increases, and thus the manufacturing cost of the light emitting chips C easily increases. Also, even when this configuration is used, it is difficult to expect the effect of further improving the image quality. For this reason, in performing the magnification correction by the method of this embodiment while suppressing the manufacturing cost of the light emitting chips C, it is preferable to use the light emitting chips C in which the integer ratio of the numbers of the light emitting thyristors L disposed to overlap in the sub scan direction is 2:3 or 3:2.

The foregoing description of the exemplary embodiment of the present invention has been provided for the purpose of illustration and description. It is not intended to be exhaustive or to limit the invention, to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A light emitting element head comprising:

a first light emitting element array that includes a plurality of light emitting elements arranged in a main scan direction, and that is provided on a single chip;

a second light emitting element array that includes a plurality of light emitting elements arranged in the main scan direction, and that is provided on a single chip different from the single chip having the first light emitting element array;

wherein the first light emitting element array and the second light emitting element array overlap each other in a sub scan direction in an overlapping section, at least one of the first light emitting element array and the second light emitting element array having a plurality of light emitting elements in the overlapping section;

an interval between the light emitting elements of the first light emitting element array in the overlapping section being different from an interval between the light emitting elements of the second light emitting element array in the overlapping section;

an interval between the light emitting elements of the first light emitting element array in a section where the first light emitting element array and the second light emitting element array do not overlap being substantially the same as an interval between the light emitting elements of the second light emitting element array in the section where the first light emitting element array and the second light emitting element array do not overlap;

an optical device that focuses a light output from the first light emitting element array and the second light emitting element array on a photoreceptor to form an electrostatic latent image on the photoreceptor; and a control unit that controls light emission of the light emitting elements of the first light emitting element array and the light emitting elements of the second light emitting element array, wherein the control unit controls a magnification of an exposure range in the main scan direction by selecting, in the overlapping section, either the light emitting elements of the first light emitting element array or the light emitting elements of the second light emitting element array and controlling the selected light emitting elements to emit light.

2. The light emitting element head according to claim 1, wherein a ratio between the number of the light emitting elements of the first light emitting element array in the overlapping section and the number of the light emitting elements of the second light emitting element array in the overlapping section is expressed as an integer ratio.

3. The light emitting element head according to claim 1, wherein a ratio between the number of the light emitting elements of the first light emitting element array in the overlapping section and the number of the light emitting elements of the second light emitting element array in the overlapping section is expressed as an integer ratio.

4. An image forming apparatus comprising:

a toner image forming unit that forms a toner image;

a transfer unit that transfers the toner image onto a recording medium; and a fixing unit that fixes the toner image to the recording medium, wherein the toner image forming unit includes the light emitting element head according to claim 1.

5. The light emitting element head according to claim 1, further comprising:

the first light emitting element array composed of a plurality of light emitting elements arranged on a first single straight line extending in the main scan direction, and the second light emitting element array composed of a plurality of light emitting elements arranged on a second straight line being parallel with the first straight line.

6. A light emitting element head comprising:

a first light emitting element array that includes a plurality of light emitting elements arranged in a main scan direction, and that is provided on a single chip;

a second light emitting element array that includes a plurality of light emitting elements arranged in the main scan direction, and that is provided on a single chip different from the single chip having the first light emitting element array;

wherein the first light emitting element array and the second light emitting element array overlapping each other in a sub scan direction in an overlapping section, at least one of the first light emitting element array and the second light emitting element array having a plurality of light emitting elements in the overlapping section;

an interval between the light emitting elements of the first light emitting element array in the overlapping section being different from an interval between the light emitting elements of the second light emitting element array in the overlapping section;

an interval between the light emitting elements of the first light emitting element array in a section where the first light emitting element array and the second light emitting element array do not overlap being substantially the same as an interval between the light emitting elements of the second light emitting element array in the section where the first light emitting element array and the second light emitting element array do not overlap;

an optical device that focuses a light output from the first light emitting element array and the second light emitting element array on a photoreceptor to form an electrostatic latent image on the photoreceptor;

the first light emitting element array being composed of a plurality of light emitting elements arranged on a first single straight line extending in the main scan direction; and the second light emitting element array being composed of a plurality of light emitting elements arranged on a second straight line being parallel with the first straight line.

* * * * *